US010435883B2

(12) United States Patent
Curtis

(10) Patent No.: US 10,435,883 B2
(45) Date of Patent: Oct. 8, 2019

(54) WALL SEAL SYSTEM

(71) Applicant: Mark Robert Edmund Curtis, Mosman (AU)

(72) Inventor: Mark Robert Edmund Curtis, Mosman (AU)

( * ) Notice: Subject to any disclaimer, the term of this patent is extended or adjusted under 35 U.S.C. 154(b) by 0 days.

(21) Appl. No.: 15/936,864

(22) Filed: Mar. 27, 2018

(65) Prior Publication Data

US 2018/0216341 A1 Aug. 2, 2018

Related U.S. Application Data

(63) Continuation of application No. 14/901,478, filed as application No. PCT/AU2014/000667 on Jun. 27, 2014, now Pat. No. 9,957,711.

(30) Foreign Application Priority Data

Jun. 28, 2013 (AU) ..... 2013206618
Nov. 26, 2013 (AU) ..... 2013263720

(51) Int. Cl.
*E04B 1/68* (2006.01)
*B28B 23/00* (2006.01)
(Continued)

(52) U.S. Cl.
CPC ..... *E04B 1/6803* (2013.01); *B28B 23/0043* (2013.01); *E02B 3/16* (2013.01);
(Continued)

(58) Field of Classification Search
CPC .... E04B 1/6803; E04B 1/6801; E04B 1/6807; E04B 2/84; E04B 1/6815; E21D 11/385; E02B 3/16; E02B 13/00; B28B 23/0043
(Continued)

(56) References Cited

U.S. PATENT DOCUMENTS 2,816,323 A 12/1957 Munger
2,865,267 A 12/1958 Bailey
(Continued)

FOREIGN PATENT DOCUMENTS

DE 1509 448 A1 8/1969
DE 1806 902 A1 6/1970
(Continued)

OTHER PUBLICATIONS

International Search Report (ISR) dated Aug. 28, 2014 for Application No. PCT/AU2014/000667.
(Continued)

*Primary Examiner* — Jeanette E Chapman
(74) *Attorney, Agent, or Firm* — Ladas & Parry LLP

(57) ABSTRACT

A flexible seal system for provision of a substantially watertight seal between adjacent concrete panels; said system comprising a first flexible seal member proximate a first end of one said concrete panel; said first flexible seal member including a surface component extending over a portion of an outer surface of said concrete panel; said surface component extending from at least one anchor component projecting from said surface component and embedded within said concrete panel; said first flexible seal member further including an overlap component extending from said surface component beyond said first end of said concrete panel; and a second flexible seal member proximate a second opposite end of an abutting said concrete panel; said second flexible seal member including a surface component extending over a portion of a surface of said abutting concrete panel; said surface component of said second flexible seal member extending from at least one anchor component projecting from said surface component and embedded within said abutting concrete panel; and
(Continued)

wherein the overlap component of the first flexible seal member is structured and selected in use to overlap the surface component of the second flexible seal member sufficient to permit welding of at least a portion of said overlap component of said first flexible seal member to at least a portion of said surface component of said second flexible seal member so as to form a continuous welded seal between and along the length of said first flexible seal member and said second flexible seal member.

16 Claims, 22 Drawing Sheets

(51) Int. Cl.

| | |
|---|---|
| ***E02B 3/16*** | (2006.01) |
| ***E04B 2/84*** | (2006.01) |
| ***E21D 11/38*** | (2006.01) |
| *E02B 13/00* | (2006.01) |

(52) U.S. Cl.
CPC ..... *E04B 1/6801* (2013.01); *E04B 1/6807* (2013.01); *E04B 1/6815* (2013.01); *E04B 2/84* (2013.01); *E21D 11/385* (2013.01); *E02B 13/00* (2013.01)

(58) Field of Classification Search
USPC ..... 52/395
See application file for complete search history.

(56) References Cited

U.S. PATENT DOCUMENTS

| | | | | | |
|---|---|---|---|---|---|
| 3,112,579 | A | * | 12/1963 | Needham | E02B 3/16 404/53 |
| 3,114,219 | A | * | 12/1963 | Bradley | E04B 1/6807 249/205 |
| 3,145,503 | A | | 8/1964 | Brechin | |
| 3,170,268 | A | * | 2/1965 | Balzer | E04B 1/6815 49/463 |
| 3,435,574 | A | * | 4/1969 | Hallock | E04B 1/6803 52/278 |
| 3,494,092 | A | | 2/1970 | Bottjer | |
| 3,696,575 | A | * | 10/1972 | Armstrong | E04B 1/6804 52/288.1 |
| 4,572,702 | A | * | 2/1986 | Bone | E01D 19/06 14/73.5 |
| 4,724,649 | A | | 2/1988 | Lowndes, III | |
| 4,749,307 | A | * | 6/1988 | Huffaker | E02B 3/16 405/119 |
| 4,751,799 | A | | 6/1988 | Ditcher et al. | |
| 4,793,162 | A | | 12/1988 | Emmons | |
| 4,922,676 | A | * | 5/1990 | Spronken | E04B 1/6801 52/396.05 |
| 5,168,682 | A | * | 12/1992 | Rye | E03F 3/04 264/274 |
| 2013/0160393 | A1 | | 6/2013 | Steinmetz | |

FOREIGN PATENT DOCUMENTS

| | | | | | |
|---|---|---|---|---|---|
| DE | 1806902 | A1 | * | 6/1970 | E02B 3/16 |
| DE | 1 7 59 022 | A1 | | 5/1971 | |
| DE | 1759022 | A1 | * | 5/1971 | E21D 11/385 |
| DE | 25 42 004 | A1 | | 3/1977 | |
| DE | 2542004 | A1 | * | 3/1977 | E02B 3/16 |
| DE | 3417 294 | A1 | | 11/1985 | |
| DE | 3803060 | A1 | | 8/1989 | |
| DE | 203 19 304 | U1 | | 4/2004 | |
| EP | 0185116 | A1 | * | 6/1986 | E04B 1/6807 |
| FR | 2 415 693 | A1 | | 8/1979 | |
| WO | 2013/057299 | A1 | | 4/2013 | |

OTHER PUBLICATIONS

English translation of FR 2 415 693 A1.
Espacenet English abstract of DE 203 19 304 U1.

* cited by examiner

INDIVIDUAL WALL PANEL ELEVATION

WALL PANEL PLAN VIEW

PROFILE

ADJACENT WALL PANELS VIEW

WALL SEAL SYSTEM

RELATED APPLICATION

This application is a continuation of application Ser. No. 14/901,478 filed on Dec. 28, 2015, which is a 371 of international Application PCT/AU2014/000667 filed on Jun. 27, 2014, which claims the benefit of Australian Applications Numbers 2013263720 filed Nov. 26, 2013 and 2013206618 filed Jun. 28, 2013, which designated the U.S., the entire contents of each of which are incorporated herein by reference.

TECHNICAL FIELD

The present invention relates to a wall seal system and, more particularly although not exclusively, to such a system suited to, although not exclusively, the flexible seal of adjacent concrete panels. More particularly, although not exclusively, the system is suited to situations where concrete panels are utilised to provide a reinforced wall structure in civil works, particularly earthworks.

BACKGROUND

There are many civil works scenarios where wall structures are required. In some instances these wall structures are made as mounds of self supporting material. In other instances the wall structure boundary is defined by and supported by a multiplicity of substantially vertically disposed concrete panels. The concrete panels allow much steeper wall definition boundaries then mounds of self-supporting material can usually provide. Where concrete panels are used in these situations there arises the problem in some instances of requiring that the resulting wall should be substantially impermeable to the passage of water of like liquids of fine solids such as sand or soil therethrough. This requirement can apply to liquid flow in a direction from within the wall structure to external the wall structure or vice versa.

As one might expect in civil works there can be movement of the wall structure over time. More particularly there can be movement of adjacent panels with respect to each other. This presents a problem to providing reliable seal of the gaps between the panels.

WO2013/057299 to Alphaplan International discloses use of the thermosetting polymer resin as a seal between adjacent panels. Its stated virtue is its hardness. Such an arrangement is not flexible and not at all suited to situations where there is movement between adjacent panels.

FR2415693 to Bachy likewise discloses a seal system for vertical joints between abutting concrete panels in which the seal members are partially embedded in the panels to emerge at niches at the corners of the panels. There corner niches form a confining channel when the panels are in situ making it difficult to heat weld a strip over the ends of the seal members, or even more difficult, welding the overlap of one of the members over the other. Other disadvantages of the Bachy arrangement arise in that firstly, the filling in of the channel after welding prevents access to the seal for inspection and secondly, allows for virtually no flexibility of movement between the panels.

It is an object of the present invention to address or at least ameliorate some of the above disadvantages.

NOTES

The term "comprising" (and grammatical variations thereof) is used in this specification in the inclusive sense of "having" or "including", and not in the exclusive sense of "consisting only of".

The above discussion of the prior art in the Background of the Invention, is not an admission that any information discussed therein is citable prior art or part of the common general knowledge of persons skilled in the art in any country.

SUMMARY OF THE INVENTION

Accordingly, in one broad form of the invention there is provided flexible seal system for provision of a substantially watertight seal between adjacent concrete panels; said system comprising:

a first flexible seal member having an anchor component and an overlap component; and a second flexible seal member having an anchor component and a surface component;

wherein the overlap component of the second flexible seal member is structured and selected in use to overlap the surface component of the second flexible seal member sufficient to permit welding of at least a portion of said overlap component of said first flexible seal member to at least a portion of said surface component of said second flexible seal member so as to form a continuous welded seal between and along the length of said first flexible seal member and said second flexible seal member.

Preferably, the length of the first flexible seal member and the second flexible seal member is a longitudinal length.

Preferably, the first flexible seal member is homogeneous.

Preferably, the second flexible seal member is homogeneous.

Preferably, the first flexible seal member is cast into a concrete panel by immersing its anchor component into at least a surface region of the concrete panel prior to the setting of the concrete from which it is formed.

Preferably, the first flexible seal member includes a surface component.

Preferably, the anchor component comprises a projection extending from the flexible seal member.

Preferably, the projection includes a bulbous portion or enlarged angular portion at a free edge thereof.

Preferably, the flexible seal member extends substantially around the entire periphery of each concrete panel.

Preferably, the anchor component comprises a substantially continuous extension, extending substantially, continuously, longitudinally, for the length of the flexible seal member.

Preferably, the anchor component comprises a substantially discontinuous, periodic extension, extending substantially, longitudinally, for the length of the flexible seal member.

Preferably, individual panels are one or more of square, rectangular, or cruciform.

Preferably, the panels are of dimension one-meter by one-meter or six-meter by six-meter or six-meter by one-meter.

In a particular preferred form, the panels are precast panels.

In an alternative preferred form, the panels are cast in situ.

In another broad form of the invention, there is provided a method of constructing a substantially waterproof wall from concrete panels; the method comprising the steps of (a) pouring concrete into formers;

(b) suspending flexible seal members of the type claimed in any one of claims 1 to 5 into the concrete prior to its setting such that at least the anchor portion of the flexible seal member is encased within the concrete;

(c) allowing the concrete to set so as to form a solid concrete panel having one or more flexible seal members anchored therein;

(d) arranging the concrete panels in juxtaposed relationship such that an overlap component of a flexible seal member of a first type overlaps at least a portion of a surface component of a flexible seal member of a second type so as to form an elongate weld zone along edges of the juxtaposed concrete panels; and (e) performing a welding operation along the length of the elongated weld zone whereby the overlap component of the flexible seal member of the first type is welded to the flexible seal member of the second type substantially along the elongated weld zone thereby to form a substantially watertight flexible seal between juxtaposed concrete panels.

In yet another broad form of the invention, there is provided a method of reclamation of landfill volume comprising substantially vertical wall structure for an inclined beam.

Preferably, the substantially vertical wall structure is constructed according to the method of constructing a substantially waterproof wall from concrete panels described above.

Preferably, the substantially vertical wall structure is constructed from concrete panels.

Preferably, the concrete panels are sealed according to any of the seal systems described in this section of the specification.

In yet a further broad form of the invention, there is provided a method of landfilling comprising the steps of:

(a) defining a substantially flat and filling area defined in part by at least a far edge region separated from a near edge region;

(b) constructing a first substantially vertical wall structure from concrete panels to a first panel height substantially along the far edge region;

(c) placing landfill up to the level of the first panel height;

(d) constructing a substantially vertical second wall structure wall structure long top edges of the first substantially vertical wall structure to a second panel height; and (e) placing landfill to the level of the second panel height.

Preferably, the concrete panels are sealed utilising any of the seal systems described in this section of the specification.

In yet a further broad form of the invention, there is provided a flexible seal system for provision of a substantially watertight seal between adjacent concrete panels; said system comprising:

a first flexible seal member having an anchor component and a surface component;

a second flexible seal member having an anchor component and a surface component; and a overlap component;

wherein the overlap component is structured and selected in use to overlap the surface component of the first flexible seal member and the second flexible seal member and the second flexible seal member so as to form a continuous welded seal between and along the length of said first flexible seal member and said flexible seal member.

Preferably, the length of the first flexible seal member and the second flexible seal member is a longitudinal length.

Preferably, the first flexible seal member is homogeneous.

Preferably, the second flexible seal member is homogeneous.

Preferably, the first flexible seal member is cast into a concrete panel by immersing its anchor component into at least a surface region of the concrete panel prior to the setting of the concrete from which it is formed.

Preferably, the first flexible seal member includes a surface component.

Preferably, the anchor component comprises a projection extending from the flexible seal member.

Preferably, the projection includes a bulbous portion at a free edge thereof

Preferably, the flexible seal member extends substantially around the entire periphery of each concrete panel.

Preferably, the anchor component comprises a substantially continuous extension, extending substantially, continuously, longitudinally, for the length of the flexible seal member.

Preferably, the anchor component comprises a substantially discontinuous, periodic extension, extending substantially, longitudinally, for the length of the flexible seal member.

Preferably, individual panels are one or more of square, rectangular, or cruciform.

Preferably, the panels are of dimension one-meter by one-meter or six-meter by six-meter or six-meter by one-meter.

In preferred forms, the panels are shaped.

In a particular preferred form, the panel is arched.

Accordingly, in a first broad form of the invention, there is provided a method of forming an irrigation or other liquid conveying channel; said method including the steps of:

(a) excavating a trench to suitable depth, (b) erecting twin opposing walls formed of concrete panels abutting one another; each of said panels provided with first and second flexible seal members, (c) welding an overlap component of a said first flexible seal member proximate an edge of a first panel, to a second flexible seal member proximate an edge of a said abutting panel, so as to form a watertight seal between said panels, and wherein said overlap component extends from a surface component of said first flexible seal member, to overlap a surface component of said second flexible seal member, each said surface component extending a long a portion of the surface of said concrete panels; said surface components affixed to surfaces of said panels by at least one anchor component projecting from said surface components and embedded in said concrete.

Preferably, said first flexible seal member comprises said surface component proximate a first edge of said concrete panel; said surface component extending over a portion of the surface of a said concrete panel; said first flexible seal member further comprising said overlap component extending from said surface component so as to extend beyond said first edge, said anchor components projecting from said surface component and embedded in said concrete panel.

Preferably, said second flexible seal member comprises said surface component proximate a second edge opposite said first edge of said concrete panel; said at least one anchor component projecting from said surface component and embedded in said concrete panel.

Preferably, wherein each said surface component is retained against said surface of said concrete panels by two said anchor components embedded in the concrete or said concreted panels; each said anchor component comprising a leg portion projecting from respective said surface components; said leg portion generally normal to said surface component; said leg portion terminating in a wider edge portion; said leg portion and said wider edge portion extending substantially along the length of said anchor component.

Preferably, said surface component, said overlap portion and said at least one anchor component of said first flexible seal member from an integral first polymer structure; said surface component and said at least one anchor component of said second flexible seal member forming an integral second polymer structure.

Preferably, each of said opposing walls is erected as to at least two horizontally arranged rows of abutting concrete panels; the number of rows defining the depth of said channel; said flexible seal members adapted to seal vertical joints between said abutting panels in each row and horizontal joints between panels of superior and inferior rows.

Preferably, each said concrete panel is provided with said first and second flexible seal members proximate respective ones of a first opposing pair of edges of said panel and proximate respective ones of a second opposing pair of edges of said panel.

Preferably, said method includes the further step of welding an overlap component of a said first flexible seal member proximate a vertical edge of a first said concrete panel, to a surface component of a said second flexible seal member proximate an adjacent vertical edge of an abutting second concrete panel to form a watertight seal between said abutting concrete panels.

Preferably, said method includes the further step of welding an overlap component of a said first flexible seal member proximate a horizontal edge of a said concrete panel of a superior row of concrete panels of said wall to a surface component of a second flexible seal member proximate a horizontal edge of an adjacent concrete panel of an inferior row of concrete panels of said wall.

Preferably, said method includes bending overlap components of said first flexible seal members at lower edges of lowermost ones of said concrete panels of said twin opposing walls of concrete panels, to extend over a portion of a bottom surface of said ditch, a liner element then laid along said bottom portion over said overlap portions being welded to said overlap portions so as to form a watertight seal between said twin opposing walls.

Preferably, each said panel is anchored into back-fill soil behind said panel by means of at least one tie back element in said soil; said at least one tie back element extending rearward from each said panel.

Preferably, each wall of said irrigation channel extends above a surface level of said back filled soil adjacent each said wall.

Preferably, said opposing walls of said channel are erected as abutting vertical concrete panels; vertical length of said vertical concrete panels defining the depth of said channel; said flexible seal members adapted to seal vertical joints between said butting vertical concrete panels.

Preferably, said abutting vertical concrete panels of said opposing walls are supported in transverse spacer elements laid along the bottom of a prepared trench at intervals equal to width of said abutting vertical concrete panels; lower edges of said abutting vertical concrete panels retained in grooves formed in opposite ends of said spacer elements, and wherein similar spacer elements engaging upper edges of said abutting vertical concrete panels act to form a controlled structure, with generally parallel vertical walls.

Preferably, said method includes the further step of welding an overlap component of a said first flexible seal member proximate a vertical edge of a first said vertical concrete panel, to a surface component of a said second flexible seal member proximate an adjacent vertical edge of an abutting second vertical concrete panel to form a watertight seal between said abutting concrete panels.

Preferably, each said abutting vertical concrete panel is provided with a second flexible seal member proximate a lower horizontal edge of said concrete panel.

Preferably, lengths of polymer material are laid along the bottom of said trench; opposing edges of said polymer material folded upwards to overlap at least a portion of each surface component of said second flexible seal member at said lower horizontal edge of each of said concrete panels; said opposing edges of said polymer sheets welded to said surface component to form a watertight seal between said polymer sheets and said vertical concrete panels.

In another broad for of the invention, there is provided a method of forming concrete panels provided with joint flexible seal members for walls for an irrigation or other liquid conveying channel; said method including the steps of:

(a) supporting said flexible seal members from formers for casting said concrete panels; said flexible seal members arranged so that anchor components of said flexible seal members project inwardly, (b) pouring concrete into said formers so as to embed said anchor components in said concrete panels; and wherein said flexible seal members for each said concrete panel comprise first and second flexible seal members; each of said first and second flexible seal members including at least an exposed surface component extending over a portion of the surface of said concrete panel; said anchor components projecting from said surface component into said concrete panel; said first flexible seal members further including an overlap component extending from said surface component; said overlap component extending past an edge of said concrete panel to overlap a said surface portion of a second flexible seal member of an abutting concrete panel when said concrete panels are erected for use; said overlap component providing seal between said panels when said overlap component is welded to said surface component of said second flexible seal member.

In still another broad form of the invention, there is provided a wall for an irrigation channel of other liquid controlling structure; said wall formed of rows of abutting concrete panels stacked one on top of another to form a substantially vertical array of said panels; each said panel provided with first and second flexible seal members arranged to overlap horizontal joints between vertically abutting panels and vertical joints between horizontally abutting panels; an overlap component of a said first flexible seal member proximate a lower horizontal edge of a panel of a superior panel, welded to a surface component of second flexible seal member at an upper horizontal edge of a vertically abutting inferior panel, and an overlap portion component of a said first flexible seal member proximate a first vertical edge of each said panel welded to surface component of a second flexible seal member at a second vertical edge of a horizontally abutting panel; said overlap component extending from a surface component of said first flexible seal member; and wherein respective surface components of each said first and said second flexible seal members are provided with anchor components embedded in concrete of said concrete panels.

Preferably, each said concrete panel is provided with a first flexible seal member along each of a first pair of contiguous edges and with a second flexible seal member along each of a second pair of contiguous edges.

In still another broad form of the invention, there is provided a panel of settable material for use in walls and other barrier structures; said panel provided with at least one first flexible seal member along one edge of said panel and at least one second flexible seal member along an adjacent edge of said panel; said first flexible seal member comprising a surface component extending over a portion of a surface of said panel and an overlap component extending from said surface component; said second flexible seal member comprising a surface component extending over a portion of said surface of said panel, wherein each said surface component is retained over said surface of said panel by at least one anchor component projecting from a respective said surface components into said settable material and, wherein said overlap component of said first flexible seal member of a first said panel is configured to overlap at least a portion of a second flexible seal member of a second said panel when said first and second panels are in an abutting relationship.

Preferably, said settable material is concrete.

Preferably, said panel is provided with one said first flexible seal members along each of two adjacent edges of said panel.

Preferably, said panel is provided with one said second flexible seal member along each of two adjacent edges of said panel.

Preferably, said panel is provided along a first two adjacent edges with said first flexible seal members and further provided along a second two adjacent edges with said second flexible seal members.

Preferably, said anchor components project from said surface components substantially at right angle into said settable material; each said anchor component comprising a leg or elongate flange ending in an enlarged portion.

Preferably, ends of said surface portions of respective said first and said second flexible seal members are mitered at their outer ends; mitrered edges of said flexible seal members fusion welded one to another to form a continuous seal surface proximate the periphery of said panel.

Preferably, said overlap component of a said first flexible seal member of one said panel is fusion or heat welded to a surface component of a second flexible seal member of an abutting said panel.

Preferably, said first and said second flexible seal members provide for impervious seals of horizontal and vertical joints between rows and columns of said panels when constructed as a barrier wall.

Preferably, said panels are arranged in said barrier wall so that abutting edges of said panels are respectively provided with a first and a second flexible seal member.

BRIEF DESCRIPTION OF DRAWINGS

Embodiments of the present invention will now be described with reference to the accompanying drawings wherein.

DETAILED DESCRIPTION OF PREFERRED EMBODIMENTS

The present invention is drawn to a flexible seal system for sealing the joints between abutting concrete (or other settable material) panels. In each of the below described embodiments, each panel is prepared when cast with a flexible seal members of two distinct configurations; a first flexible seal member and a second flexible seal member. Both the flexible seal members include at least one anchor component embedded within the concrete and a surface portion which extends over, or overlays, a portion of the outer surface of the panel. The first flexible seal member is distinguished from the second flexible seal member in that an overlap portion extends from its surface portion in such a way that the overlap portion extends beyond the edge of the panel.

Figure 1:
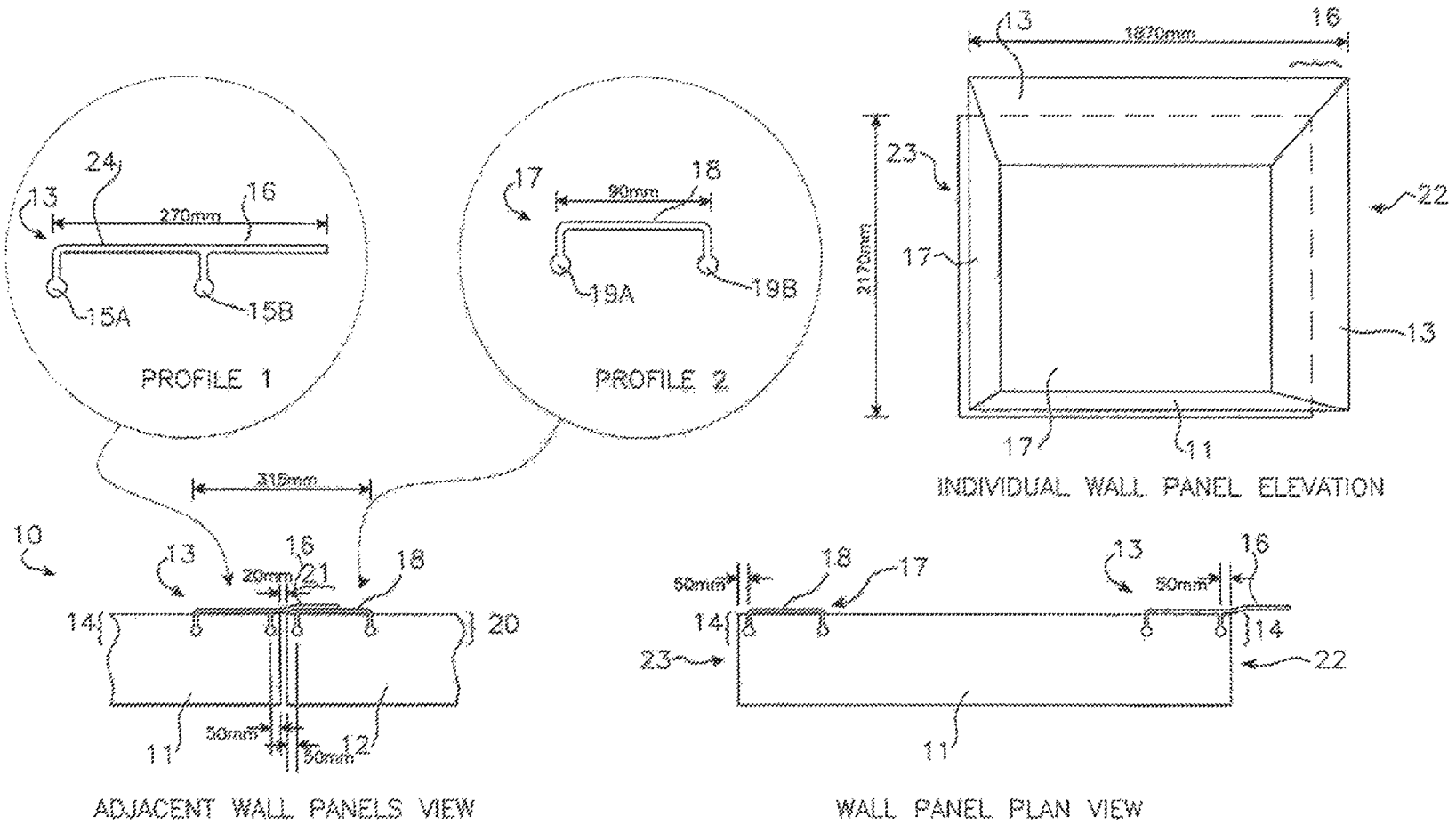
FIG. 1 comprises views as illustrated of a flexible seal system in accordance with a first preferred embodiment applied to adjacent concrete panels.

With reference to FIG. 1, there is illustrated a first embodiment of a flexible seal system 10 used to create a substantially watertight seal between, in this instance, a first concrete panel 11 and a second concrete panel 12. As shown in the plan view there is a first flexible seal member 13 proximate a first end of concrete panel 12. First flexible seal member 13 includes a surface component 24 extending over, and anchored into, a surface region 14 first concrete panel 11. In this instance the first flexible seal member 13 further includes at least an anchor component formed as legs or elongate flanges 15A, 15B which, in this instance project substantially normal from and are cast into the surface region 14 of the first concrete panel 11, leaving the surface component 24 exposed above surface region 14. Each of the legs 15A, 15B ends in an enlarged portion for securely embedding the anchor components in the concrete of the panel. The first flexible seal member 14 further includes an overlap component 16 mechanically supported by and extending from the surface component 24 to extend past the end of the concrete panel 11. The first flexible seal member 13 thus described is shown in profile 1 of FIG. 1.

The flexible seal system 10 further comprises a second flexible seal member 17, disposed proximate a second end of an abutting concrete panel 12, comprising, in this instance, a surface component 18 extending over a portion of the surface region 20. Second flexible seal member further includes an anchor component 19 in this instance in the form of a first leg 19A and a second leg 19B projecting preferably substantially at right angles from surface component 18. The legs 19A and 19B are cast into the surface region 20 of second concrete panel 12 in such a way as to anchor surface component 18 reliably into the second concrete panel 12 whilst leaving surface component 18 exposed above surface region 20.

The flexible seal members are arranged so that each concrete panel is provided with a first flexible seal member along each of a first pair of contiguous edges and with a second flexible seal member along each of a second pair of contiguous edges. Thus the differences between the first and second flexible seal members provides, in this embodiment, for scaling around both the vertical and horizontal edges of the panel.

Figure 1A:
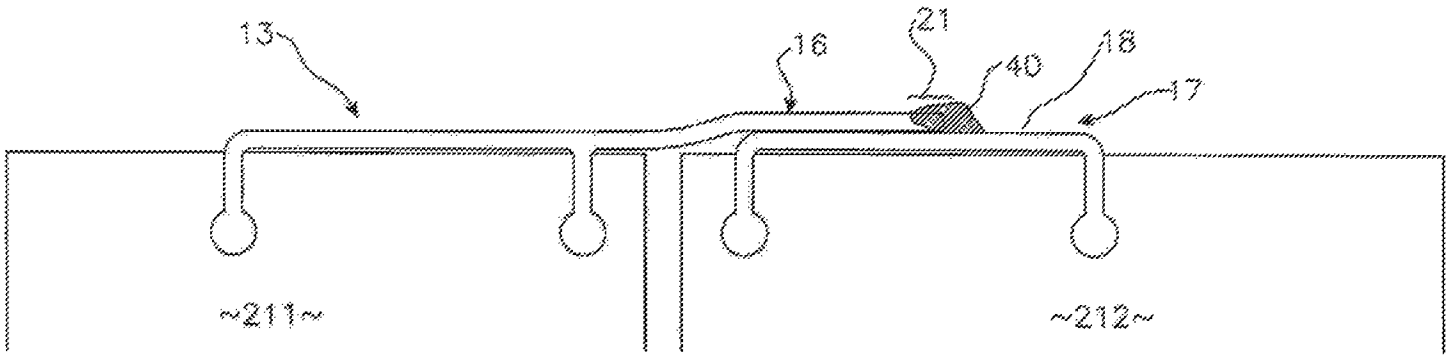
FIG. 1A comprises a side section detail view of a welded portion of the flexible seal of members of FIG. 1.
Figure 1B:
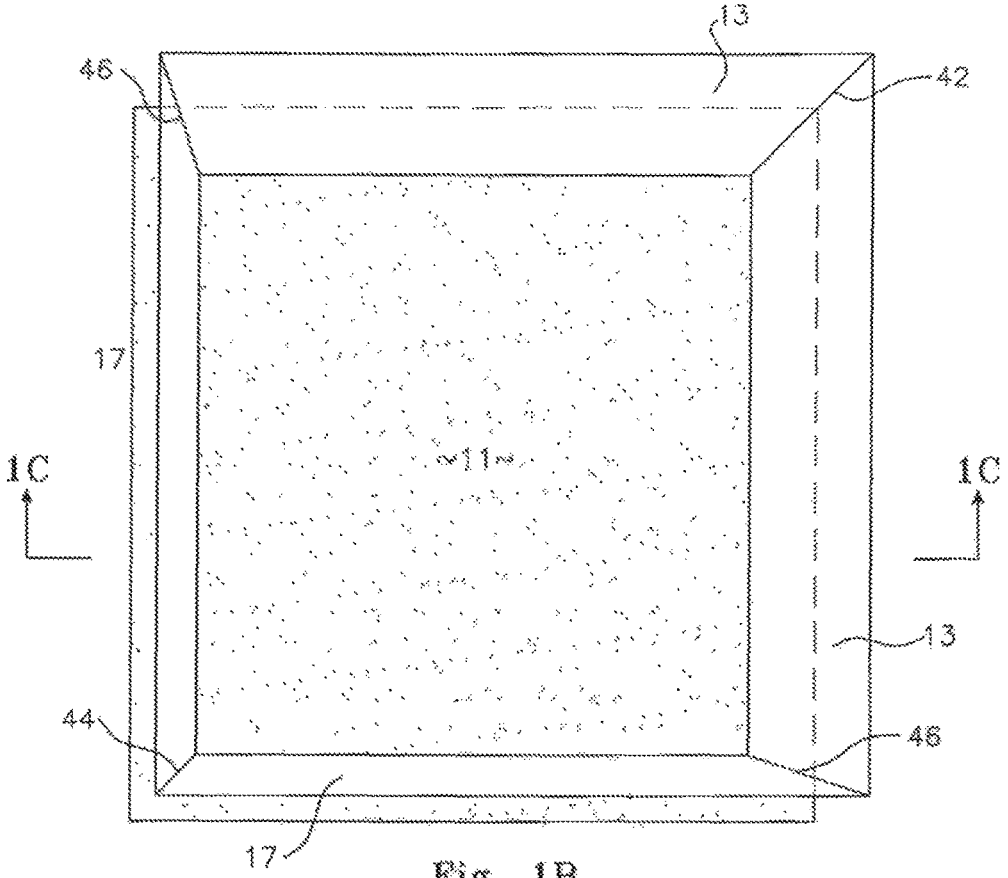
FIGS. 1B and 1C comprise a further plan and sectioned end view with enlargements of the flexible seal members of FIG. 1.
Figure 1C:
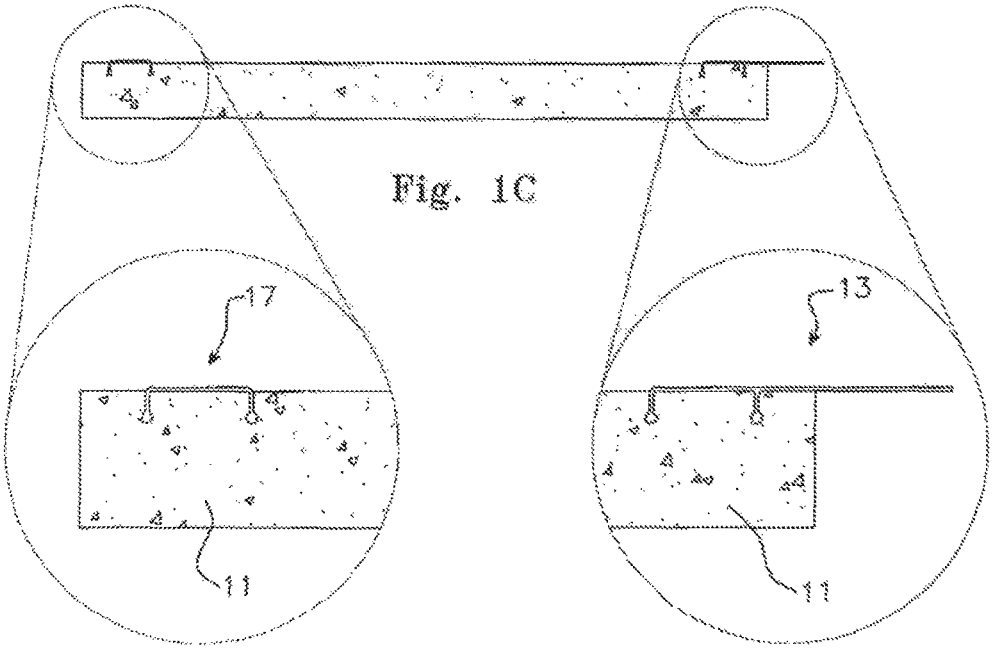

As shown in the plan view of a concrete panel 11 prepared with the flexible seal system of the invention in FIG. 1B, the ends of the first flexible seal members 13 at their intersection 42 are mitered and welded to form a watertight continuous seal surface. Similarly the second flexible seal members 17 at their intersection 44 are mitered and welded. The junctions 46 between first and second flexible seal members are also mitered and welded so that there is formed a continuous seal surface at the perimeter of the concrete panel. The cross sectioned view and enlargements of FIG. 1C show the description of each of the first and second flexible seal members and their anchor portions relative the opposite edges of the concrete panel.

The concrete panels of this preferred embodiment may be formed as follows. The flexible seal members are prepared in lengths to suit the dimensions of the panel to which they are to be applied and the ends mitered as described above. The first and second flexible seal members are then welded at their intersections to form the continuous seal surface and relative the formwork so as to become embedded within the concrete, and leaving the surface components extending over the surface. One the concrete has set, pressure testing of the flexible seal members completes the process.

Each of the first and second flexible seal members comprises an integral polymer structure. In use the first concrete panel 11 and the second concrete panel 12 are juxtaposed in sufficiently close relationship that overlap component 16 or at least a portion of it overlaps a longitudinal length of at least a portion of the surface component 18 as shown in the plan view of FIG. 1 thereby to define a weld zone 21.

It should be noted that the surface component extending along an outer surface of the concrete panel with the overlap portion disposed as shown in FIGS. 1 and 1A, affords considerable flexibility to the seal of the invention, allowing some movement between two adjacent panels in at least two directions. Moreover, the relatively short distance the anchor components of the two flexible seal members intrude into the concrete allows the flexible seal system of the invention to be used with relatively think concrete panels. This may be contrasted for example with the arrangement of FR2415693 to Bachy discussed above, in which the arrangement of the flexible seal members require a much greater thickness of panel. It is noted also that the Bachy system creates and inherent weakness in the concrete by the long intrusion likely to lead to cracking.

The overlap component 16 and surface component 18 are made from a weldable plastics material whereby, following the juxtaposition of the adjacent panels the overlap component 16 is welded along its length to the surface component 18 by means not shown. Preferably, the overlap component of the first flexible seal members is of thinner or more pliable than the anchor components.

Preferred materials for the flexible seal members 13, 17 include plastics materials, in particular, plastic materials which have the capacity to stretch and flex and preferably to be welded one to the other.

Suitable materials include polymers; HDPE; PVC; Teflon and polymer blends. Preferably these materials may be particularly selected and optimized for properties such as elongation, resistance to chemicals, and resistance to heat. Polyethylene and polypropylene are particularly suited for petrochemical applications. PVC of PET may be suited to water applications.

Preferably the same material is used for both the first flexible seal member 13 and the second flexible seal member 17 thereby to assist in homogeneity of the weld (see below).

A preferred process of welding is thermal fusion welding utilising a modified plastics extruder machine (not shown) that can be hand operated and which extrudes a molten bead of High Elongation resin through a "stepped" die head over an overlapping weld zone 21. Preferably the weld zone 21 is prepared via abrasion prior to extrusion welding to remove surface grit and contamination.

In preferred forms the weld consumable comprises the same material composition as that of the first flexible seal member 13 and second flexible seal member 17. At FIG. 1A is a side section view of a preferred form of weld showing the consumable 40 enveloping a beveled edge portion of the overlap component 16 and at least a portion of the surface component 18.

Preferably, each weld is tested for water tightness at the completion of the weld. In a preferred method, after preparing the seal to be tested with a suitable liquid, a plexiglass dome, provided with a seal around its periphery, is placed over the area to be tested and a partial vacuum created under the dome to show up any imperfections. This testing is facilitated by the ready access available to the overlap component of the first flexible seal member and the bead of welding along the overlap edge.

With reference to the wall panel plan view of FIG. 1 a preferred arrangement for the first concrete panel 11 is to have a flexible seal member of the first flexible seal member 13 aligned along a first edge 22 thereof and to have a second flexible seal member 17 aligned along an opposite parallel second edge 23 thereof as illustrated. Panels of like types and flexible seal member arrangements can then be juxtaposed side-by-side in the manner illustrated in the adjacent wall panels plan view of FIG. 1. In this embodiment a preferred distance between edges of adjacent panels is approximately 20 mm and with the opposed anchor component inset approximately 50 mm from an edge of an opposed panel edge with the overlap component extending approximately 130 mm from an edge of the panel into which is anchored so as to thereby provide a weld zone of around 60 mm and where the face of the surface region of the second flexible seal member over which it extends is of the order of 90 mm in width.

Typical precast concrete panel or cast in situ panel dimensions can be of the order of 1870 mm×2170 mm or as required by the application. The panels themselves may be square, rectangular, cruciform, arched or other suitable shapes preferably adapted for adjacent abutting of long edges thereof.

In preferred forms the flexible seal members are applied on the "inside" of the resulting barrier structure. That is to say on the side abutting the material or liquid which is being retained by the structure.

Second Preferred Embodiment

Figure 2:
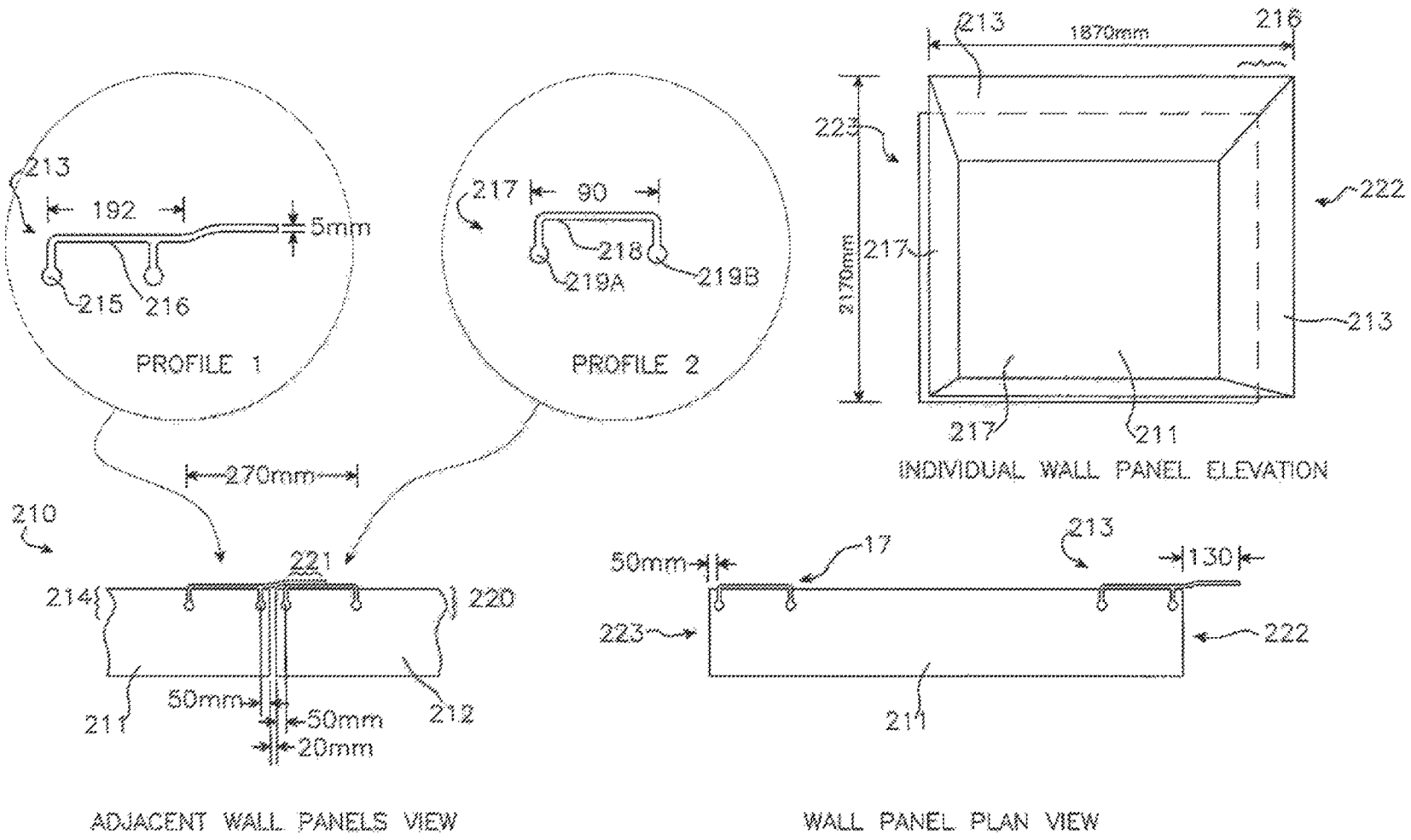
FIG. 2 comprises views as illustrated of a flexible seal system in accordance with a second preferred embodiment applied to adjacent concrete panels.
Figure 2A:
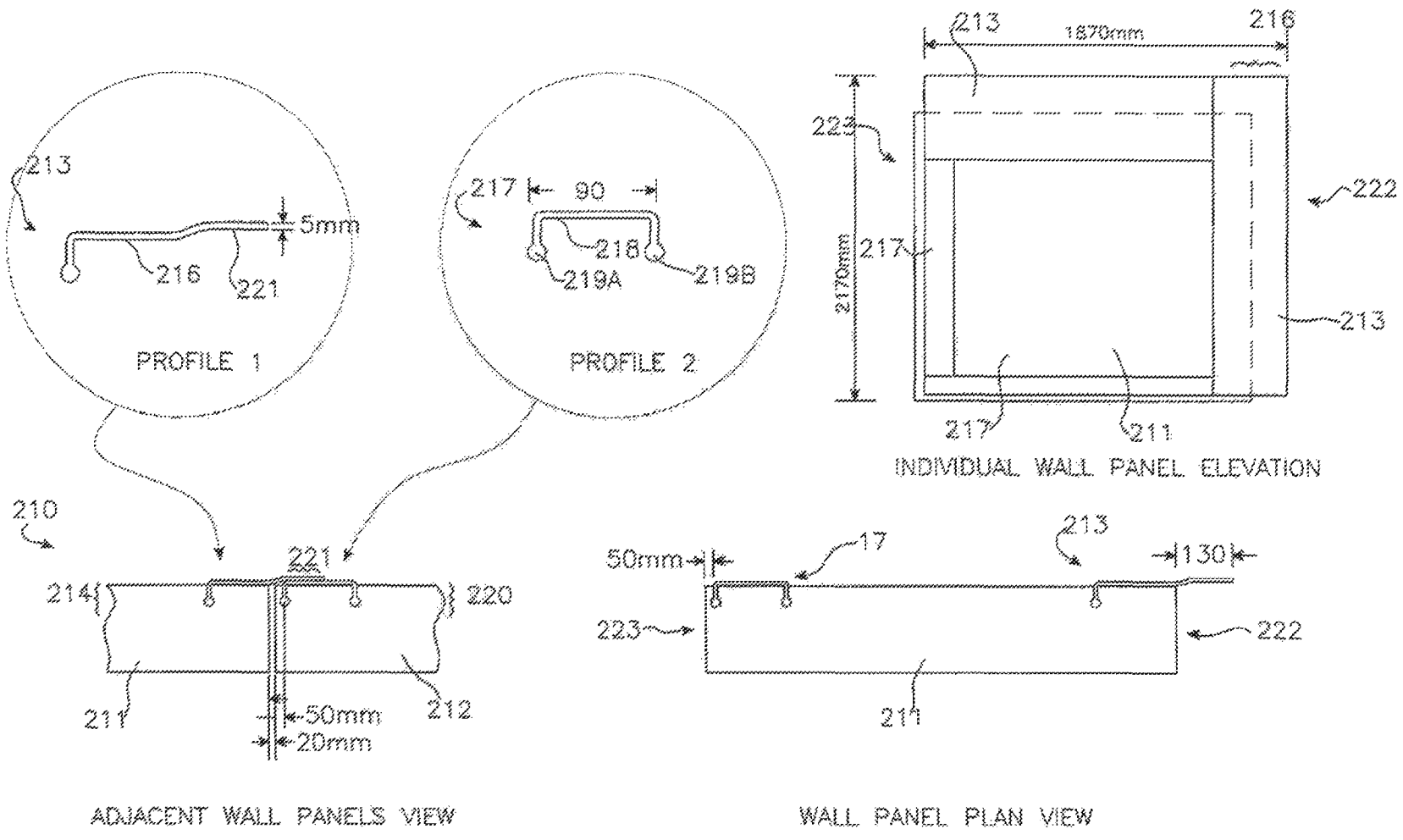
FIGS. 2A and 2B comprise a view of variations of the flexible seal system of FIG. 2.
Figure 2B:
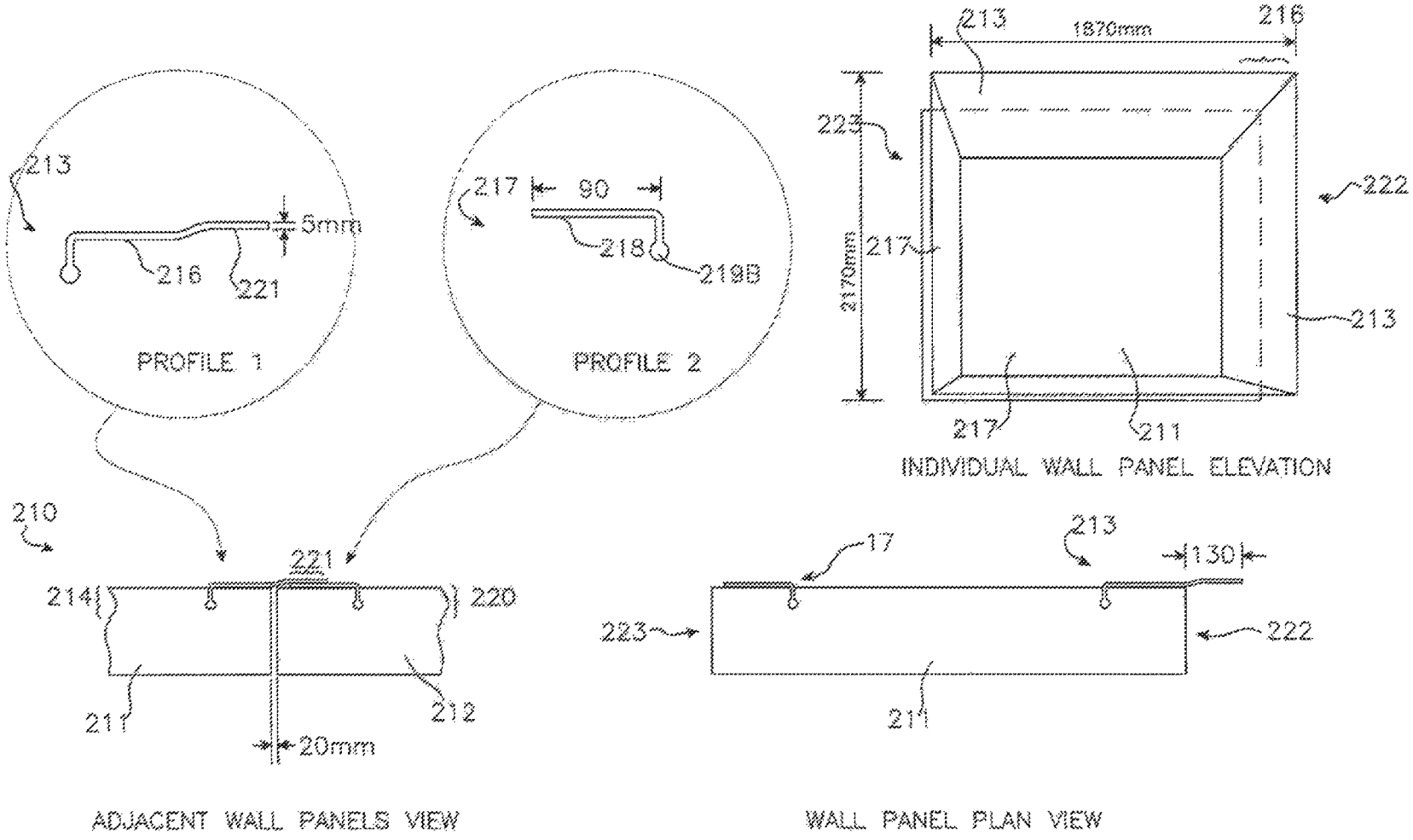

With reference to FIG. 2 there is illustrated a second embodiment of a flexible seal system 210 wherein like components are numbered for the first embodiment described with reference to FIG. 1 except in the 200s series. In this instance first flexible seal member 213 includes a single anchor component 215 subtending from surface component 24 which, in this instance, then extends integrally to the overlap component 216.

The overlaps of the arrangement of FIG. 2 are approximately the same as for the arrangement of FIG. 1.

Third Preferred Embodiment

Figure 3:
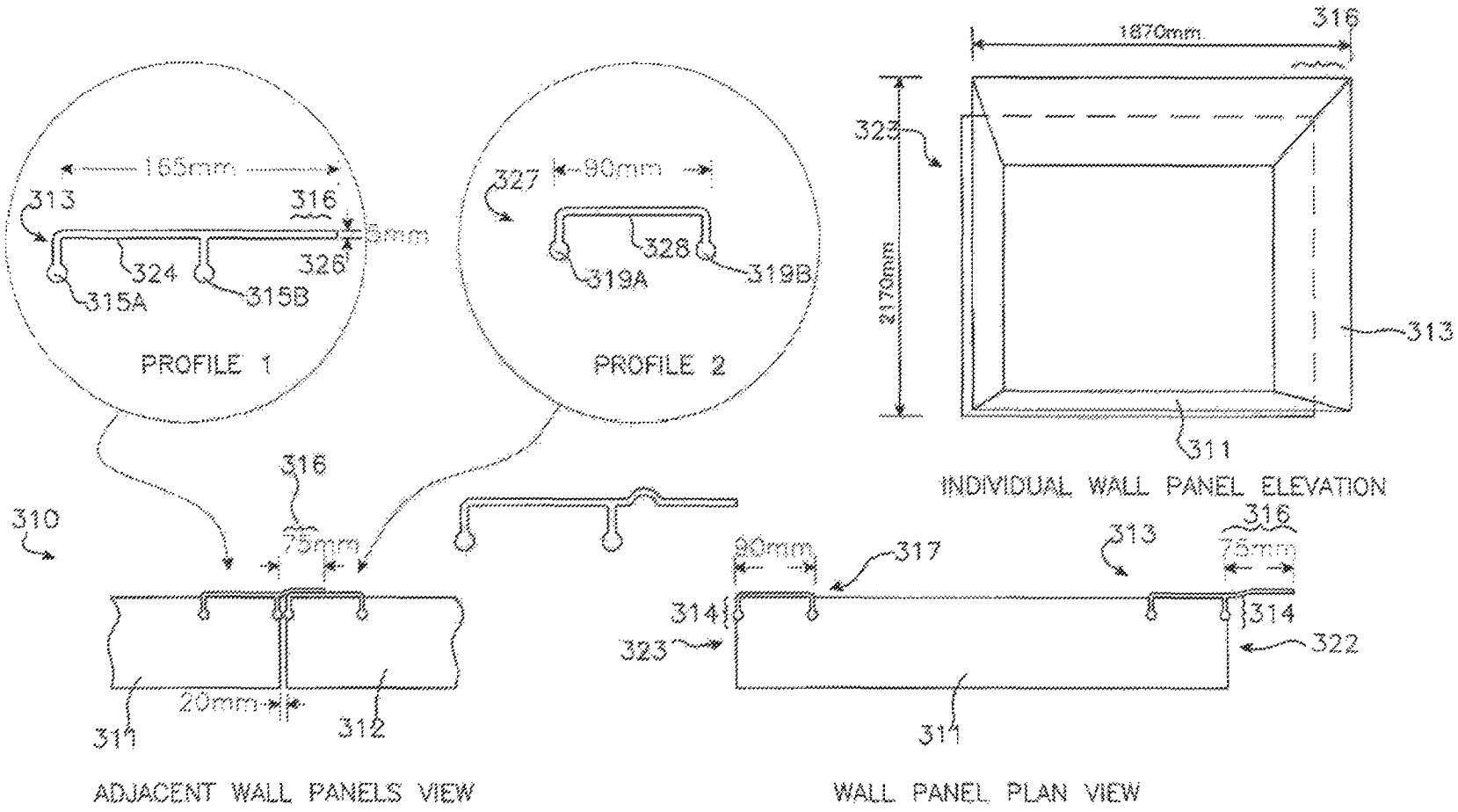
FIG. 3 comprises views as illustrated of a flexible seal system in accordance with a third preferred embodiment applied to adjacent concrete panels.
Figure 3A:
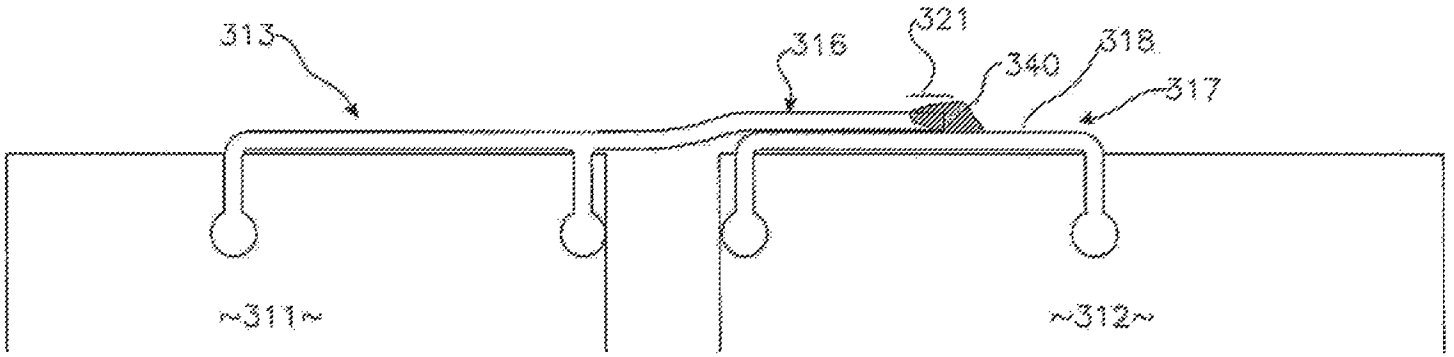
FIG. 3A comprises a side section detail view of a welded portion of the flexible seal of members of FIG. 3.

With reference to FIG. 3 there is illustrated a third embodiment of a flexible seal system 310 where like components are numbered as for the first embodiment described with references to FIG. 1 except in the 300s series. The construction of the flexible seal members 313, 317 is substantially the same as that for the first embodiment. In this instance the second flexible seal member is placed as close to an edge of the concrete panel as possible rather than inset 50 mm as was the case with the arrangement of FIG. 1. Correspondingly the extension of the overlap component 316 may be reduced to 75 mm as a result.

Figure 4:
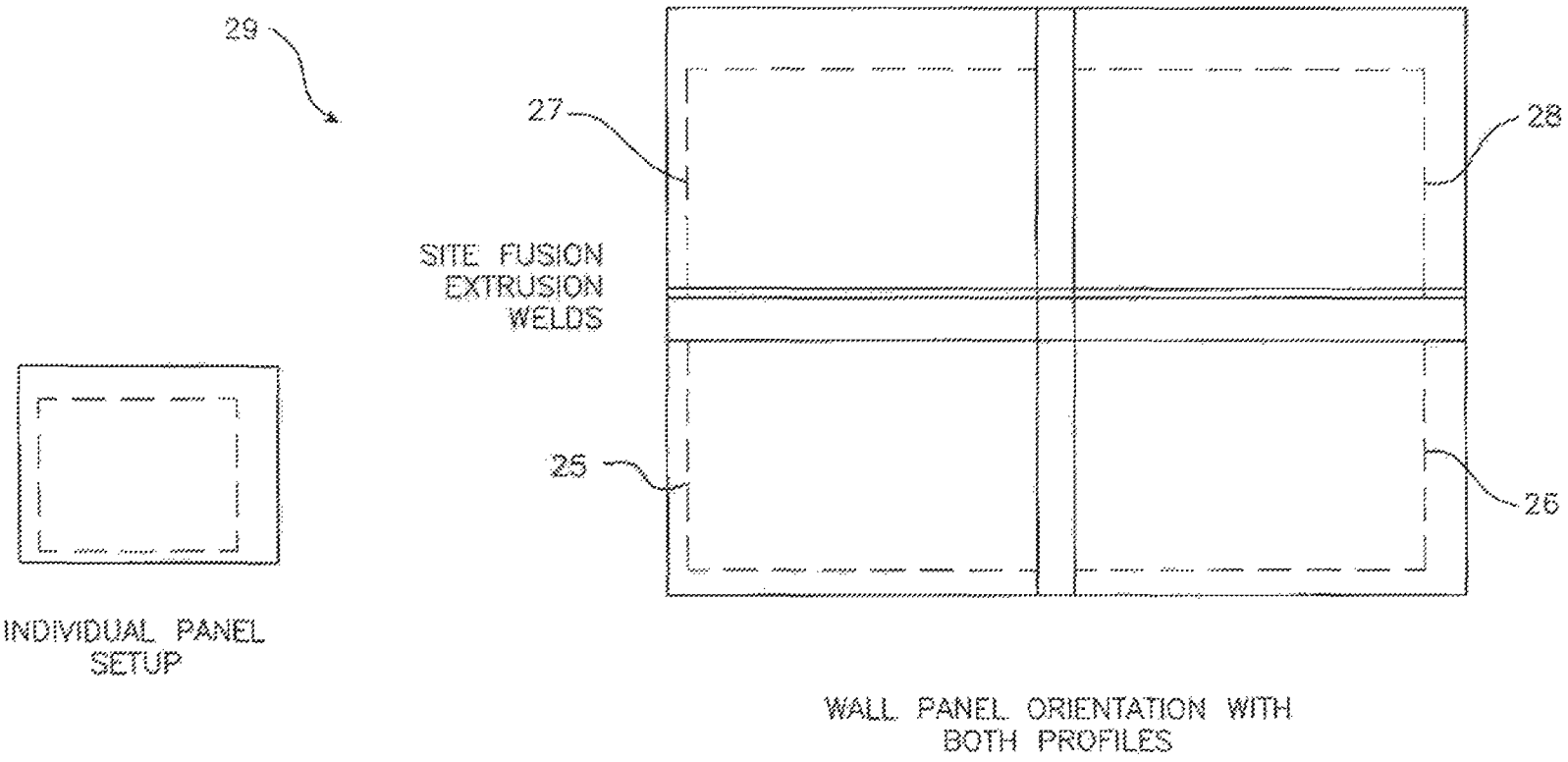
FIG. 4 illustrates a wall panel arrangement constructed form the embodiments of any one of FIGS. 1 to 3.

As shown in FIG. 4 further panels can then be stacked on the initial longitudinal alignment of panels and joined by welds along all four edges to create a wall structure of substantially any length and any height. In this instance a wall structure 29 is comprised of lower juxtaposed panels 25, 26 joined at weld zone 30 above which are placed further panels 27, 28 which are themselves joined at weld zone 31. Upper panel 27 is joined at weld zone 32 to lower panel 25 whilst upper panel 28 is joined to lower panel 26 at weld zone 33 thereby to form a wall structure comprised of four concrete panels.

Figure 4A:
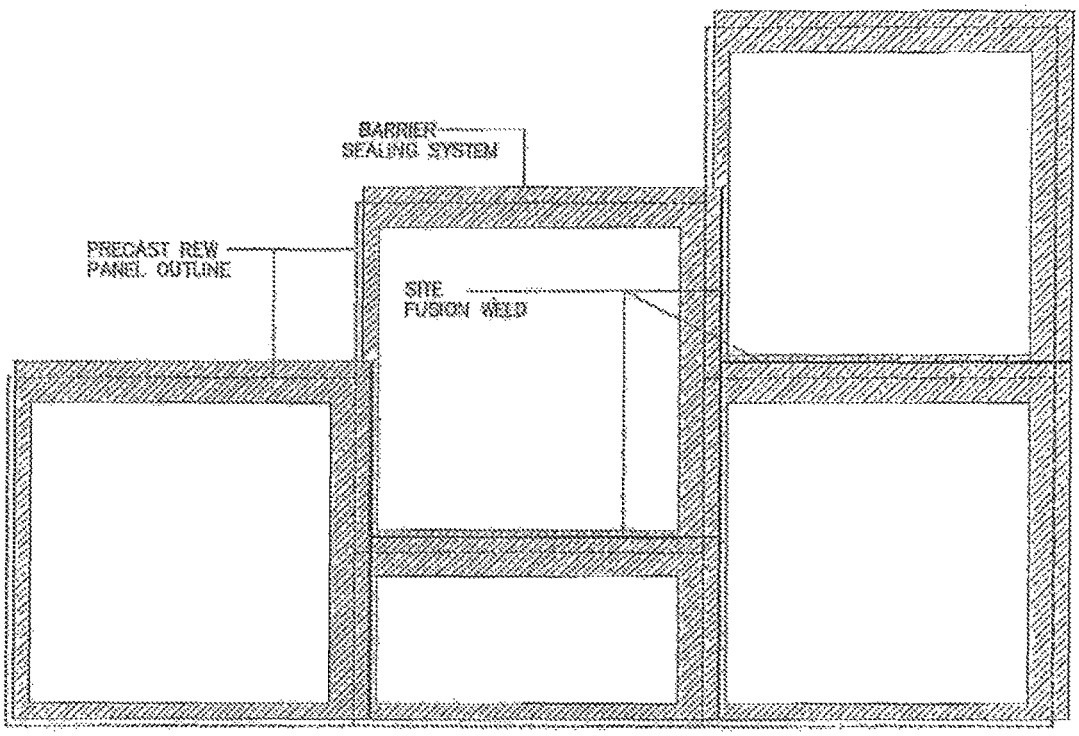
FIG. 4A illustrates a staged wall construction approach

FIG. 4A illustrates the cross section a staged wall construction that may be applied with a vantage in some circumstances.

The wall panel arrangement of FIG. 4 or 4A can be used by way on non-limiting example of a dam wall, tunnel arch, tank farm vertical bund wall, sea wall.

In addition, in respect of any one of the above described embodiments, a fire-resistant/heat-resistant/chemical-resistant/UV-resistant expandable and/or flexible sealant or mastic may be inserted in the gap region between adjacent panels. In some forms this will be for the purpose of providing UV resistance. In other forms it will be for the purpose of providing heat resistance. In some forms this will be particularly for protecting the welded flexible seal.

Reclamation System

The above described system can be utilised as part of methodology to reclaim landfill volume.

Figure 5:
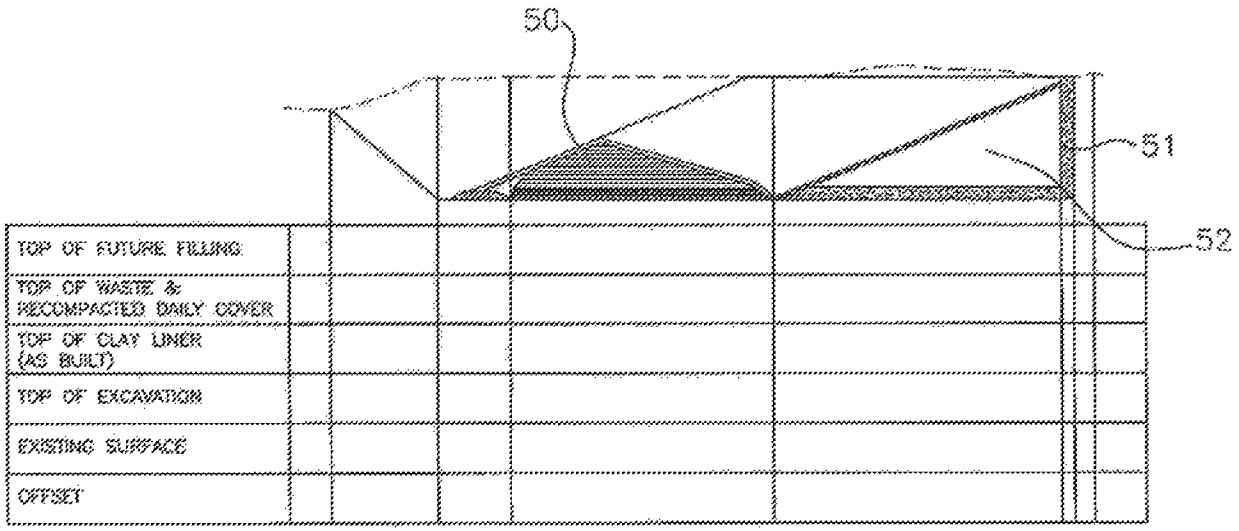
FIG. 5 is a diagrammatic arrangement of a methodology for defining a landfill volume.

With reference to FIG. 5 there is illustrated a beam 50 traditionally used to define a boundary for a landfill volume.

An alternative arrangement which permits use of substantially the volume of the berm involves use of a substantially vertical wall structure 51 thereby permitting use of volume 52 that otherwise would be occupied by the berm itself.

Advantageously, the vertical wall structure 51 is constructed utilising the arrangements described with references to the earlier embodiments of FIGS. 1 to 4.

Figure 6:
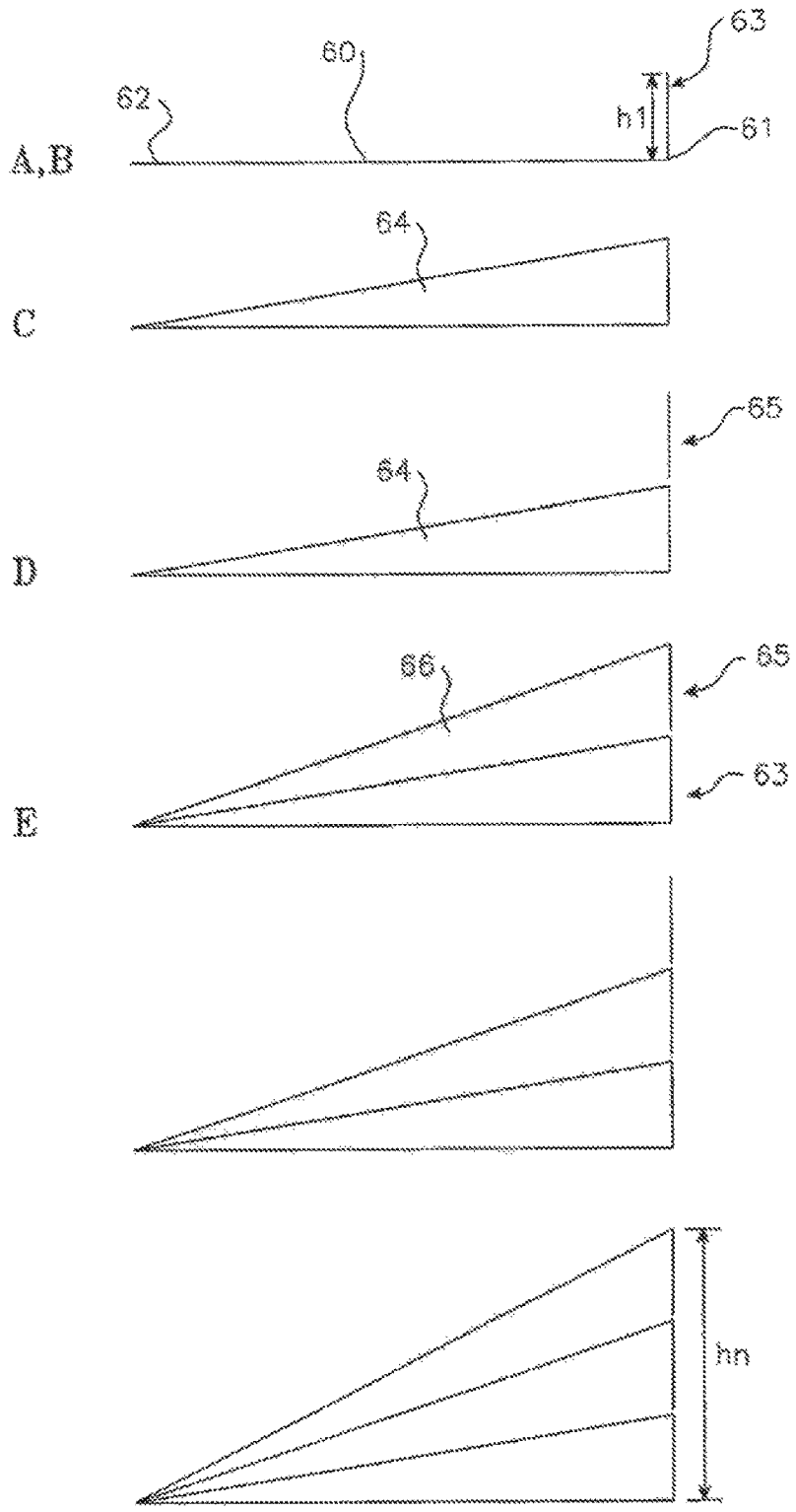
FIG. 6 illustrates a methodology for defining a landfill volume which can advantageously utilise the wall seal system of any one of FIGS. 1 to 3.

With references to FIG. 6, a preferred systems which can be used as part of a landfill system includes:

(a) defining a substantially flat filling area 60 defined in part by at least a far edge region 61 separated from a near edge region 62
(b) constructing a first substantially vertical wall structure 63 from concrete panels to a first panel height h1 substantially along the far edge region 61.
(c) placing landfill 64 up to the level of the first panel height h1
(d) constructing a substantially vertical sound wall structure 65 along top edges of the first substantially vertical wall structure 63 to a second panel height h2
(e) placing landfill 66 to the level of the second panel height h2. The process may be continued as necessary until a desired maximum wall height hn is achieved.

In some applications a liner may be applied to the filling area 60. In some applications a contiguous liner may be applied over the inside face of the wall structure 63, 65.

Applications for embodiments of the invention described above include, but not are limited to:

(a) Water retained structures
(b) Hydraulic barrier structures such as sea walls or cut off walls
(c) Chemical spill barrier structures in tankfarm bundwall storages
(d) Retaining wall barriers
(e) Waterproofing of the low grade concrete structures
(f) Waterproofing of tunnel arch structures
(g) Volume capacity reclaiming structures for landfills In a preferred arrangement in which the concrete panels with the flexible seal system of the invention are used for sequential erection of a wall defining the boundary of the refuse land fill, the concrete panels are erected with the flexible seal members on the rear surface of the panel, that is away from the refuse land fill. In this arrangement, the flexible seal member along the lower horizontal edge of the lowermost or first row of panels of the wall, is the second flexible seal member described above and designated 17 in FIGS. 1 and 1A. A liquid proof seal between the wall and ground cover sheet of the land fill area can then be made by extending the polymer ground sheet of the land fill surface to lie under the foundation or toe of the wall to curve upward and, after the concrete panels are erected, welding the edge of the ground cover sheet to the flexible seal member of the panel.

Fourth Preferred Embodiment

Figure 7:
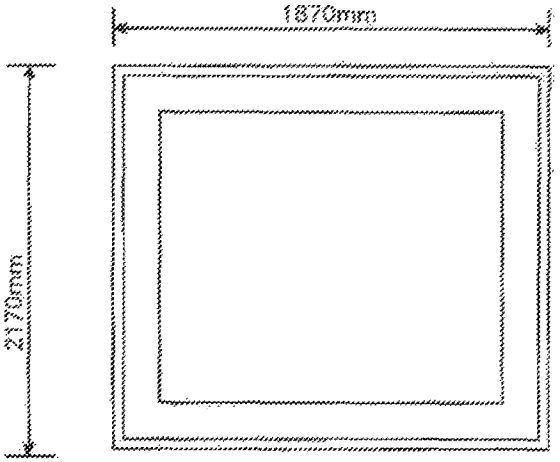
FIG. 7 comprises a view as illustrated of flexible seal system in accordance with a fourth preferred embodiment, applicable to any of the above-described methodologies.
Figure 7:
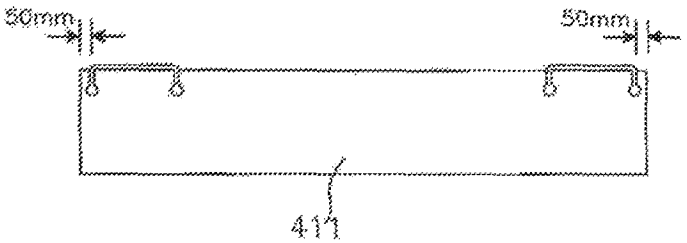
Figure 7:
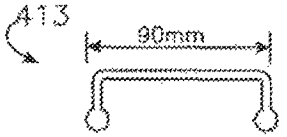
Figure 7:
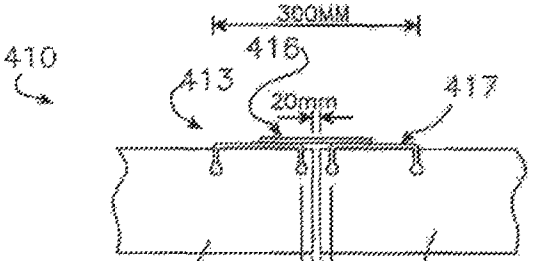

With reference to FIG. 7, there is illustrated a wall seal system 410, in accordance with a fourth preferred embodiment of the invention, wherein like components are numbered as for earlier embodiments, except in the 400 series.

In this instance, the overlap component 416 comprises a separate component from the first flexible seal member 413 and the second flexible seal member 417. Accordingly, in use, the adjacent wall panels 411, 412 are juxtaposed and then the overlap component 416 is applied so as to overlap at least a portion of both the first flexible seal member 413 and the second flexible seal member 417, and substantially along the entire length thereof. The overlap component 416 is then welded to both flexible seal members 413, 417.

This embodiment is suited for use in most situations where the previously-described embodiments are applicable.

Fifth Preferred Embodiment

Figure 8:
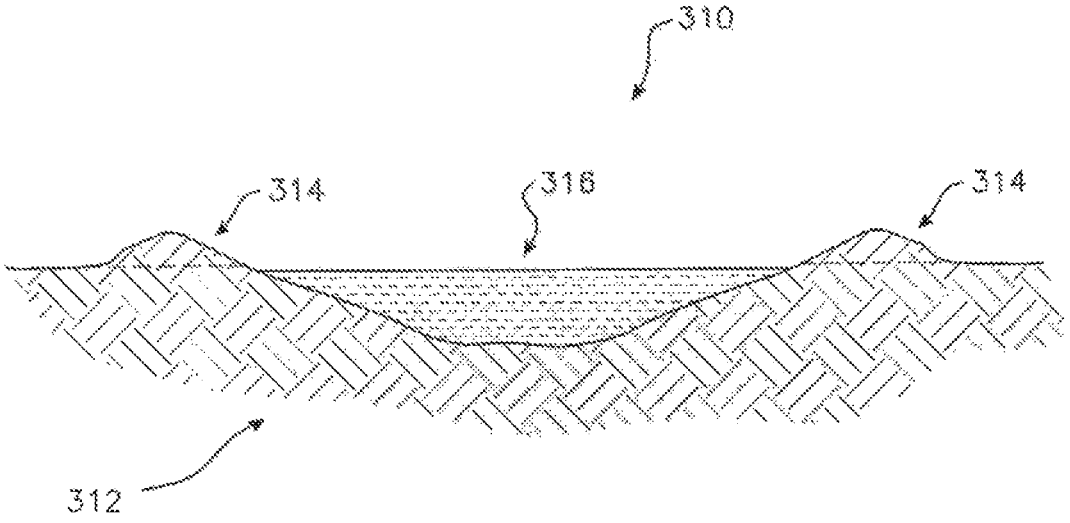
Fig. 8 (Prior Art)
FIG. 8 is a cross section of a typical irrigation channel according to prior art, FIGS. 9 and 9A respectively show an irrigation channel constructed with the flexible seal system of the invention and a detail of a section of that channel.
Figure 9:
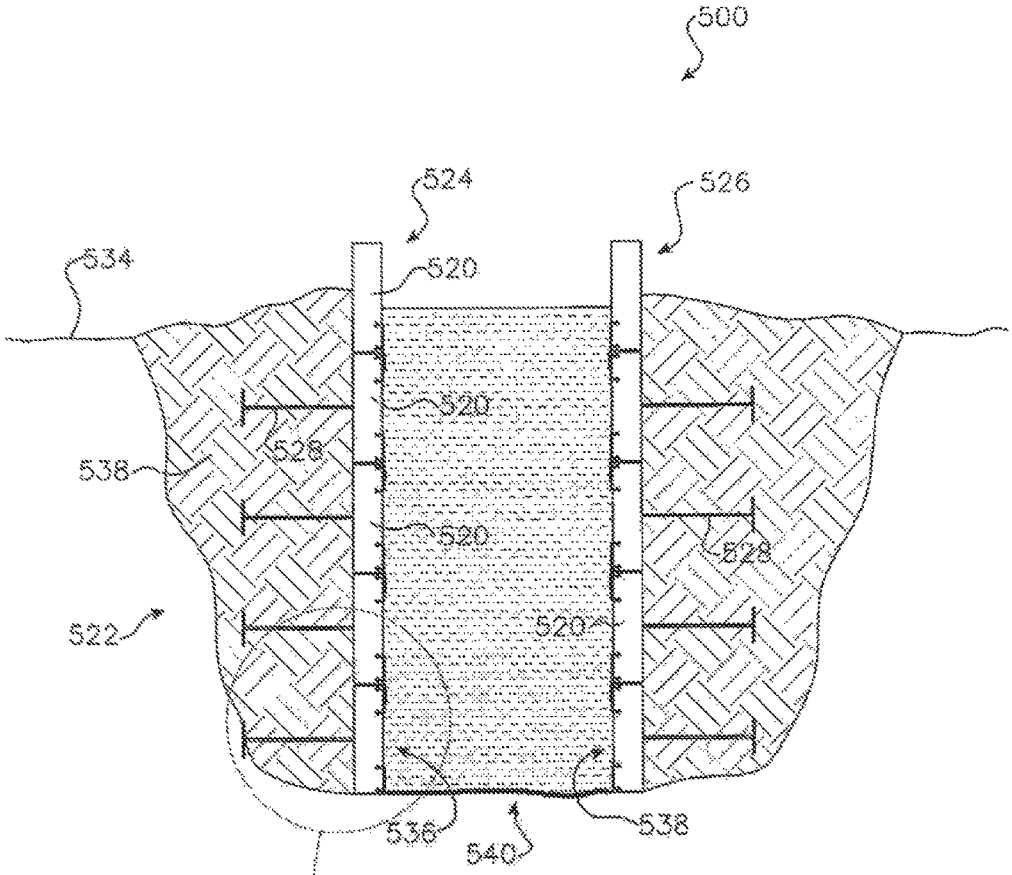

In this preferred embodiment of the invention, wherein like components are numbered as for earlier embodiments, except the 500 series, the panels described above are arranged to form an irrigation channel 500 as shown in the cross section view of FIG. 9. Typically, many conventional irrigation channels 510 are formed in the manner shown in the cross section view of FIG. 8 (prior art). These channels are formed by excavating a relatively shallow broad ditch 512 with the excavated material arranged in berms 514 on either side of the formed channel. In most cases, the sides of the channel are no more than compacted earth which degrades the water carrying efficiency through seepage. In some cases, the bottom and sides of the channel may be lined with concrete to prevent loss through seepage. In both cases however, the surface area 516 exposed to evaporation is large relative to the volume of water per unit length of the channel.

With references now to FIG. 9, in the present embodiment, panels 520 provided with the first and second flexible seal members as described above and as shown in the various embodiments of FIGS. 1 to 3, are arranged in an excavated channel 522 in rows to form substantially vertical, twin opposing walls 524 and 526. In this instance, each of the panels 520 may be provided with at least one conventional "tie-back" 528 anchoring the panels to the back-filled, compacted soil areas 528 and 530. In at least one preferred form, the proximate ends of the tie back elements 528 may be cast into the rear portions of the panels 520. In a more preferable arrangement, the panels 520 may be provided on their rear sides with securing elements (not shown) cast into the concrete for attaching the tie back elements thereto.

Depending on the desired depth of the channel to be constructed, and on the size of the panels to be employed, a number of panels 520 are arranged stacked one on top of another to a level at which the twin opposing vertical walls 524 and 526 extend above the level of the adjacent ground surface 534. The panels may be stacked in vertical alignment or may be staggered by a proportion of their length. Preferably the walls extend a meter above the surface, or to a level where access to the channel by wild and feral animals is prevented.

As described above, the flexible seal members anchored in each of the panels, are arranged so that a first flexible seal member of the type labelled 513 (13 in FIG. 1 or 213 in FIG. 2) is at the lower edge of the panel while the second flexible seal member of the type labelled respectively 518 (218 in FIGS. 1 and 2), is disposed at the upper edge. Thus as shown in the enlarged view of a section of the wall 524, the overlap component of the first flexible seal member 513 overlaps the surface component of the second flexible seal member 518 along the surface of the wall. When welded in the manner described above, the flexible seal members provide a waterproof seal over the horizontal joints between the stacked panels.

Panels 520 are further provided with complementary flexible seal members at their vertical edges and the panels positioned such that a flexible seal member 513 is adjacent to a flexible seal member 518. Thus similarly, the vertical joints between longitudinally abutting panels may also be sealed by the welding of the overlapping portion of flexible seal members 513 to flexible seal members 518.

Figure 9A:
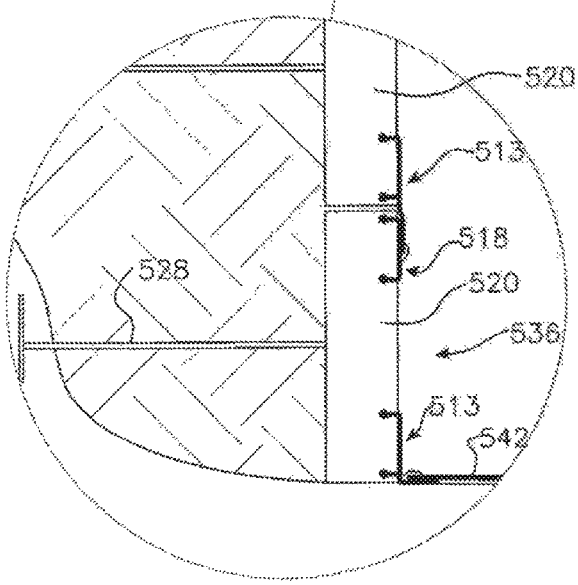

The overlap portions of the first flexible seal members 518 of the lowermost panels 336 and 338 of each of the walls, may be bent and laid against surface of the bottom 340 of the channel as shown in FIG. 9A. A liner 542 of a compatible impervious polymer material is then laid to overlap the flexible seal members and preferably welded to them in the same manner as already described to provide a watertight flexible seal between the twin opposing walls of the channel.

It can be seen that the method of construction of irrigation channels by means of the panels of the invention provides a number of advantages over conventionally constructed channels. Firstly the panels are easily and rapidly erectable, especially, if in a preferred form, cast in low density concrete. Secondly the cast-in flexible seal members provide a simple and effective means of making the joints between abutting panels watertight. Furthermore the overlap components of the flexible seal members at the lower edges of the lowermost pane provide a unique element for the welded attachment of a liner for the bottom of the channel. Finally, the relatively narrow surface area to depth of the channel minimises water loss through evaporation.

Sixth Preferred Embodiment

Figure 10:
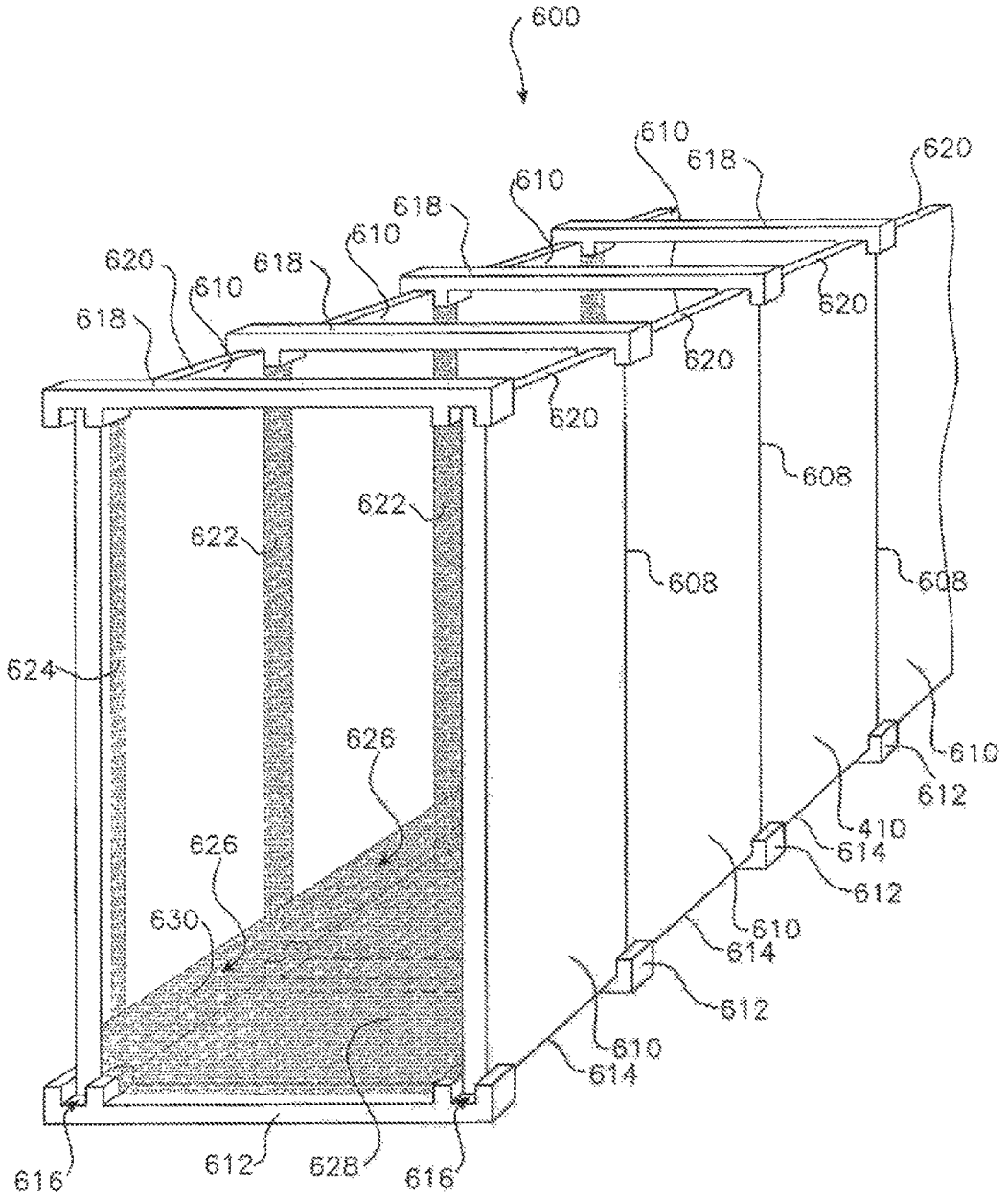
FIG. 10 is a perspective view of an alternative construction of an irrigation channel constructed with concrete panels provided with the flexible seal system according to the invention.

With reference now to FIG. 10, in this further preferred embodiment of an irrigation channel 600, wherein like components are numbered as for earlier embodiments, except in the 600 series, precast concrete panels 610 provided with first and second flexible seal members as previously described, again form the opposing walls of the channel. In this instance however, the walls comprise of series of single vertical panels 610 extending the depth of the channel.

Panels 610 are located in spacer elements 612 laid along the bottom of a prepared trench at intervals equal to the width of the panels 610. The lower edges 614 of the panels 610 are retained in grooves 616 formed in the ends of the spacer elements 612. Similar spacer elements 618 are located along the upper edge 620 of the panels 610 to form a controlled structure, with generally parallel vertical walls.

Sealing along the vertical joints 608 between adjacent panels 610 is by means of the first and second configured flexible seal members described above, with the overlap component 622 of the first configured flexible seal member of one panel, welded to the surface portion of the second configured flexible seal member 624 of the adjacent panel. Usually, though not necessarily, the panels 610 will be erected with the first and second flexible seal members directed to the inside of the irrigation channel as shown in FIG. 10, but in some applications the flexible seal members may be disposed on the outside of the panels.

Panels 610 of this preferred embodiment are provided proximate their lower edges with a flexible seal member 626 of the form described above as the second configured flexible seal member. That is, a flexible seal member extending across the width of the panel 610 and comprising a surface component from which project at least two anchor components embedded into the concrete of the panel.

The bottom of the channel 600 may be formed of a sheet 628 of polymer material compatible with that of the flexible seal members of the panels. These sheets forming the base of channel are formed or folded into a channel form with upturned flanges 630 which are then welded to the flexible seal members (not visible) along the lower edges of the panels. The sheets are of a length to overlap the width of the panels (as well as the spacer elements) so that the edge of an overlap of one sheet may be welded to the surface of the next adjacent sheet. Alternatively, the sheet 628 may be of sufficient length to extend past a number of panels 610 and spacer elements 612.

By these means, the vertical joints between panels 610 and the bottom of the channel 400 are rendered water tight by the welding of various flexible seal members and bottom sheets.

In some applications it may be desired to clad the bottom of the channel with concrete slabs extending between adjacent spacers so as to provide a protective floor over the polymer sheets. By this means for example, mechanical equipment may be used to clean the channel from sediment and accumulated debris.

The construction method illustrated in FIG. 10 allows for a minimum excavation and obviates the need for a "tie-back" of the panels into the adjacent soil body. Although for irrigation channels, the top of the channel 600 will usually remain open, it will be understood that the upper spacer elements 618 (or the upper edges 620 of the panels 610) may provide support for concrete cover slabs or other coverings, such as a security mesh for example.

In at least one preferred embodiment, the panels 610 are provided proximate their upper edges 620 with first flexible seal members as described above. The channel may then be covered over with panels provided on their undersides with flexible seal members according to the invention to which the overlap components of the flexible seal members of the vertical panels may be welded. Thus the channel in this embodiment may become a fully sealed conduit or tunnel for the movement of liquids under some pressure.

Although the above embodiments are drawn to an irrigation channel, it will be appreciated that the panels and wall seal system of the invention may be applied to other liquid conveying channels such as storm water channels for example. It will further be appreciated that although the above described panels are planar, the flexible seal members of the invention may equally be applied to the edges of curved panels to form arched structures.

In one arrangement the panels and seal system of the invention may be adapted for the construction of a tunnel for conveyance of cabling or traffic for example. In this case the vertical and horizontal panels are arranged with the flexible seal members on the outward surfaces of the panels to make the joints between panels proof against external hydraulic pressure.

Further Preferred Embodiment

Figures 11, 12:
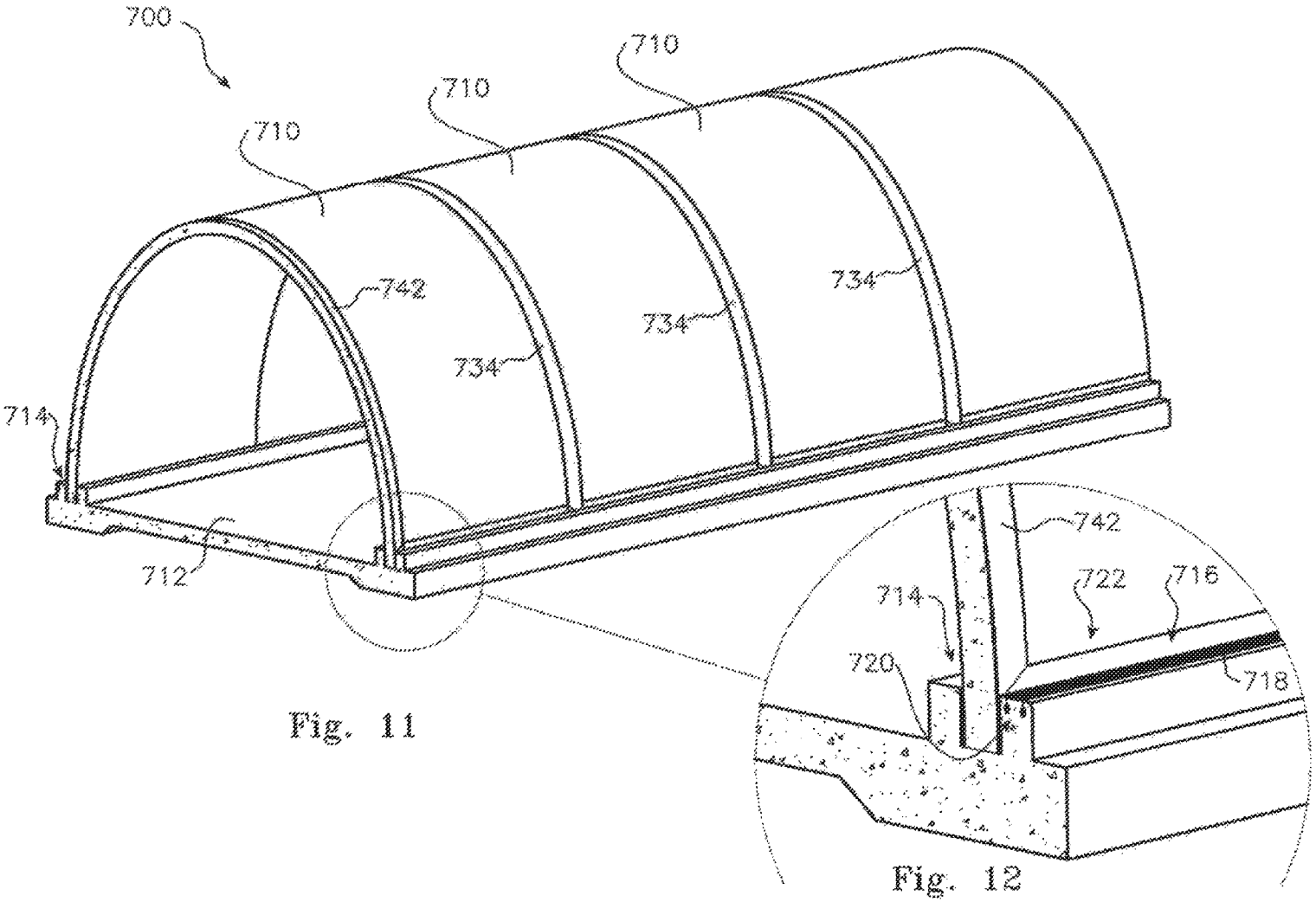
FIGS. 11 and 12 are perspective views of the flexible seal system of the invention applied to a tunnel structure.

In yet a further embodiment of the invention, the seal system may be applied to the seal of tunnels formed of curved panels to form arches as shown in FIG. 11. Considering firstly the tunnel arrangement shown in FIG. 11, it can be seen that the tunnel 700 comprises a series of one-piece arched units 710 supported in a base slab 712, with the ends of the arched units 710 located in channels 714 cast into the base slab 712. Watertight flexible seal at the base of the arched units 710 of this arrangement of the tunnel 700 may include bedding the ends of the arched units 710 in a seal compound within the channels 714. Alternatively, sealing along the channels may be achieved by providing the outer ledge 716 of the channels with a flexible seal member of the second type as described above; that is a flexible seal member comprising a surface component 718 extending between two anchor components 720 as can be seen in the enlargement of FIG. 12. The surface components 720 provide for sealing with overlap components of first flexible seal members provided on the arched unit as explained below.

Figure 13:
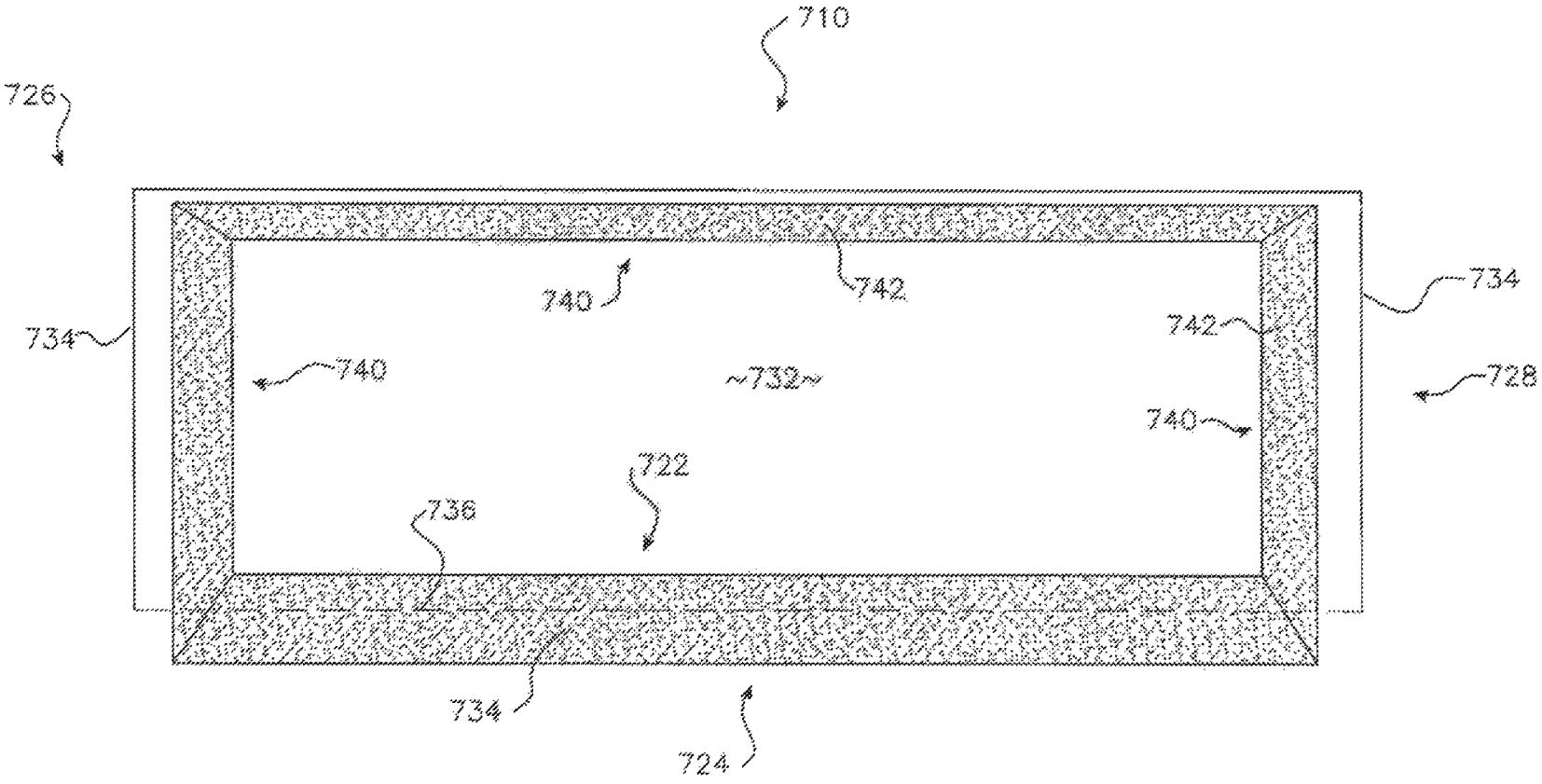
FIG. 13 is a plan view of a panel prepared with flexible seal members according to the invention for application in the tunnel structure of FIG. 11.

The curved panels 710 for the tunnel 700 of FIG. 11, are analogous to the panels for vertical walls described above and as illustrated in FIG. 13, in which an curved panel 710 and its flexible seal members are represented by a plane two-dimensional figure. It can be seen that the curved unit 710 is provided with the flexible seal members 722 of the first type along one long side 724 (that is extending over the curve of the curved panel) It will be recalled that the first flexible seal members comprises a surface component 730 extending over the surface 732 of the concrete from one, or preferably from between two anchor components, (not visible) embedded in the concrete of the curved panel, and an overlap component 734 extending beyond the perimeter 736 of the concrete curved panel. The two short sides 726 and 728 (that is the two base ends of the curved panel) are provided with the wide flexible seal members of the second type, with the remaining opposite long side 738 (that is extending over the curve of the panel) also provided with a second flexible seal member 740. Again it will be recalled that is a second flexible seal member comprises a surface component 742 extending over the surface 732 of the concrete from at least one, preferably two, embedded anchor components (not visible). The flexible seal members 722 and 740 form a continuous seal by mitering and welding at the intersecting corners.

In use, as shown in FIG. 11, the overlap component 734 of a first flexible seal member projecting from the curved edge of a first covered panel, overlaps the surface component along the curved edge of an adjoining curved panel and is heat welded to the surface component. In the arrangement of FIG. 11 (and as best seen in the enlargement of FIG. 14), the ends of the curved panels 710 may be sealed into the channel 714 of the base slab 712 by means of a sealing compound firstly placed in the channel.

Figure 14:
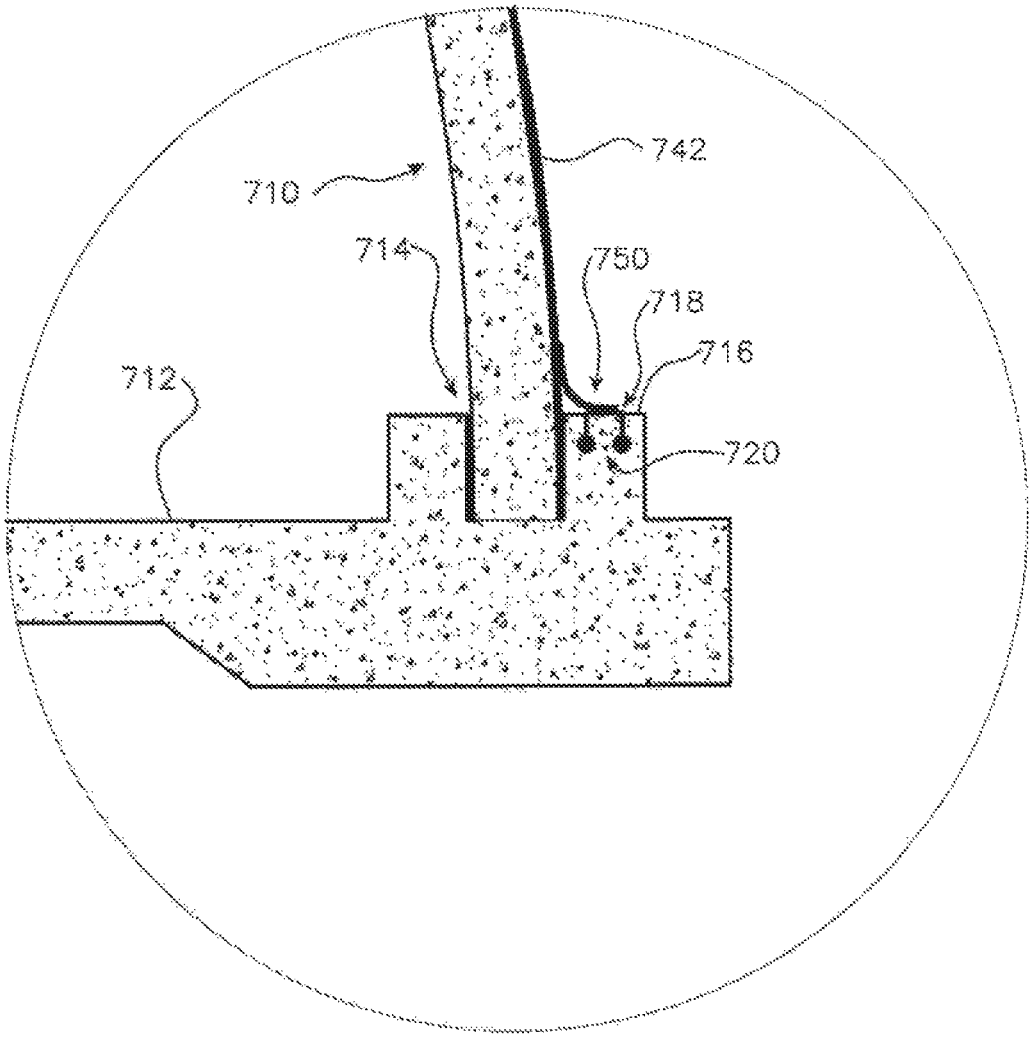
FIG. 14 is detailed enlarged view of a flexible seal arrangement between the panel of FIG. 13 and a base slab of the tunnel structure of FIG. 11.

Alternatively, as also shown in the detailed view of FIG. 14, separate flashing strips 750 may be welded both to the surface component of the flexible seal members 742 at the ends of the curved panel, and to the surface component 718 of the flexible seal member provided along the outer ledges 716 of the channels 714 as explained above. Thus the tunnel panels 710 are completely sealed panel to panel and to the base slab 712.

Figure 15:
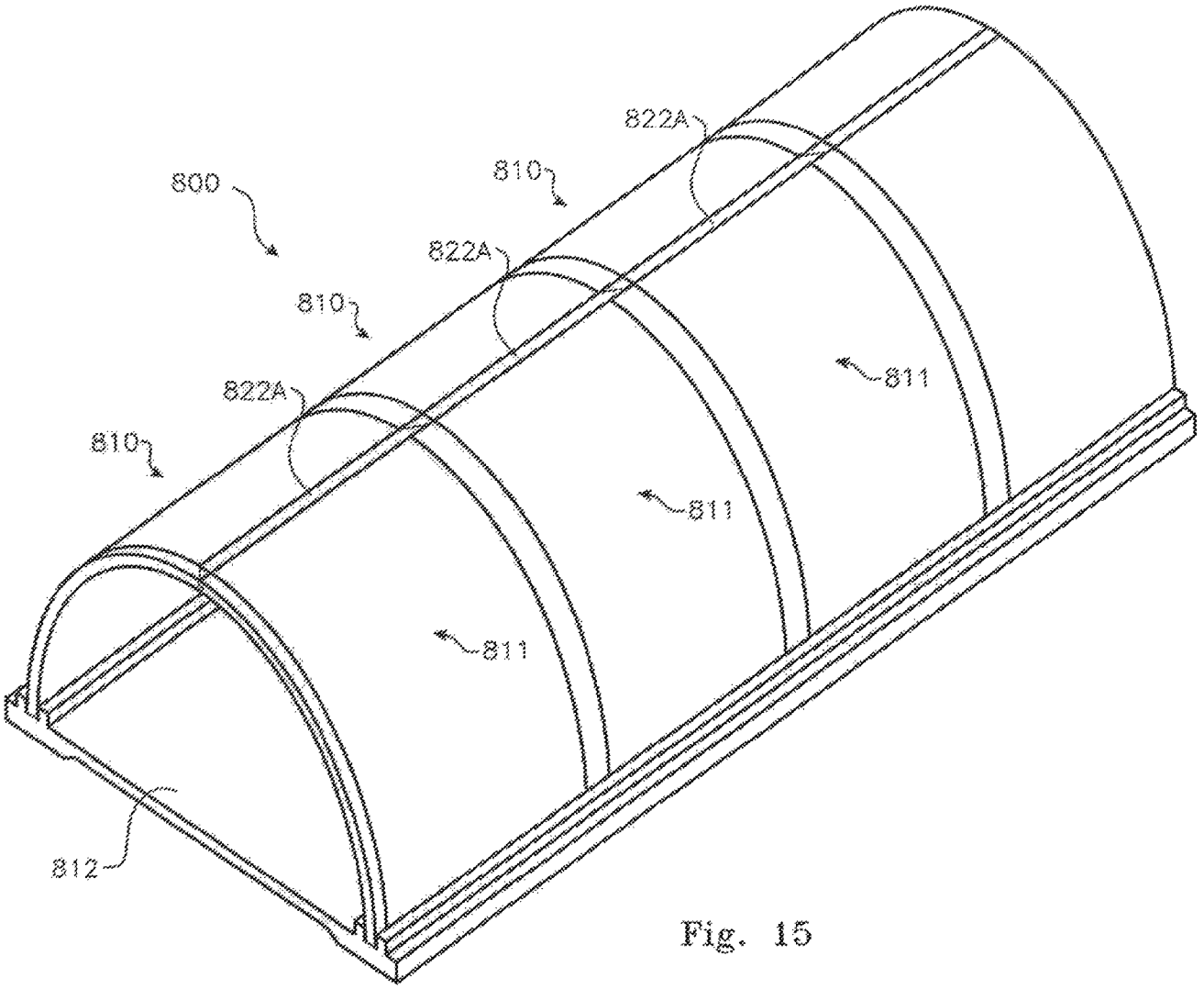
FIG. 15 is a perspective view of a flexible seal system according to the invention for an alternative tunnel structure.

In an alternative arrangement of a tunnel sealed with the seal system of the invention, a tunnel 800 as shown in FIG. 15, in this instance is formed of curved panels made up of pairs of cooperating curved panels 810 and 811. The lower ends of the curved panels 810,811 are again located in a similar base slab 812 provided with channels as described above. The joint at the upper ends of the curved panels

Figure 16:
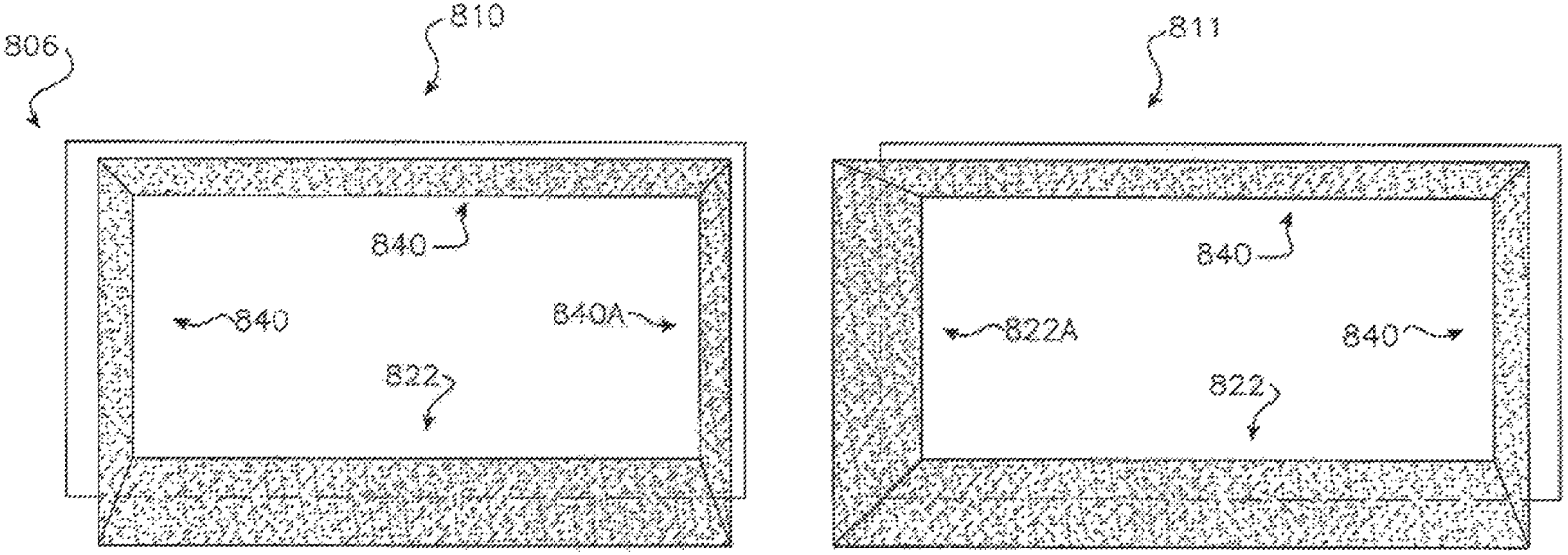
FIG. 16 shows plan views of a pair of panels and flexible seal members for the tunnel structure of FIG. 15.
Figure 17:
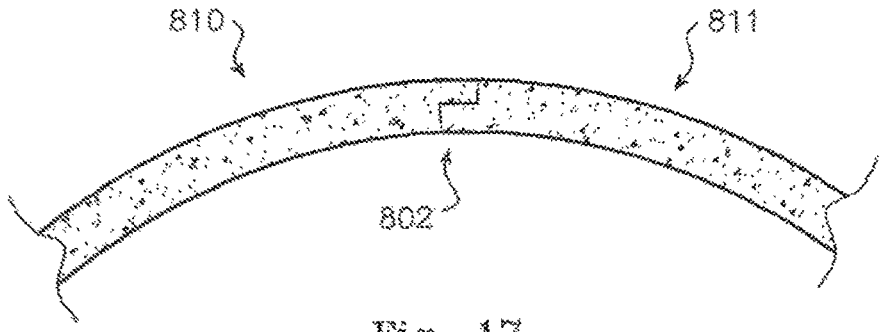
FIG. 17 shows a section view of a two piece arch structure.

810,811 may be arranged variously, for example as a stepped joint 802 or with a key block 804 a shown in the enlargements of FIGS. 16 and 17.

In this arrangement in which each arch unit comprises a pair of curved panels 810, 811 the pairs are arranged with flexible seals as shown in FIG. 16. Again, one long side of each panel is provided with a first flexible seal member 822 while the opposite long side is provided with a second flexible seal member. In this instance one of the pair of panels (say 811) is provide at its lower channel-sealing end 806 with a second flexible seal member 840 but at its upper, jointing end, with a first flexible seal member 822A. The other panel of the pair (thus 810) is provided with flexible seal members in the same configuration as the panels of the single panel arches 710 and shown in FIG. 13. The method of scaling of the tunnel 800 is similar to that of the previously described tunnel 700 in every respect except that the scaling of the joint between the upper ends of a panel 810 and a panel 811 is now achieved by the overlap component of the first flexible seal member 822A of panel 811 being heat welded to the surface component of second flexible seal member 840A. In this case of the panels 810 and 811 being joined via a key block 804, the overlap component of flexible seal member 822A is simply increased in width to cover the joints at either side of the key block.

Figure 18:
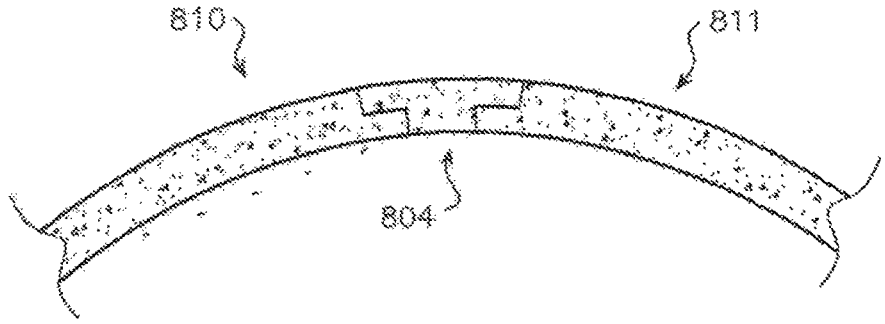
FIG. 18 shows a section view of a two piece and coupling arch structure.
Figure 19:
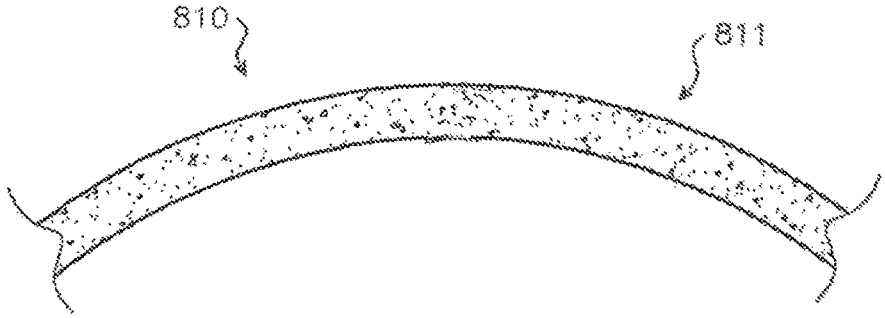
FIG. 19 shows a section view of a single piece arch structure.

As illustrated in cross section in FIGS. 17, 18, 19, the concept may be applied to either single piece arches, two piece arches or two piece and coupling-type arches.

Embodiments of the invention as discussed above may be applied with advantage to concrete tank reservoirs and also to concrete building structures where the concrete construction may be either of the pre-cast or in situ type.

In one further arrangement of the seal system according to the invention, the system may be applied to bund walls for dams. In this instance the bund walls may be formed of vertical concrete panels as described above. Sealing between the panels is provided with the same first and second flexible seal members arranged at the edges of adjoining panels.

In a further preferred arrangement, the seal system of the invention may be applied in the construction of the walls or tanks in a tank farm. In this case vertical panels are arranged to form either rectangular or circular enclosures with the vertical joints between abutting panels sealed by the first and second flexible seal members. The base of a tank so formed may comprise a sheet of compatible material which can be thermal fusion welded to the flexible seal members at the lower edges of the vertical panels to form a watertight tank enclosure.

The invention claimed is:

1. A flexible seal system for provision of a substantially watertight seal between adjacent concrete panels; said system comprising a first flexible seal member proximate a first end of one said concrete panel; said first flexible seal member including a surface component extending over a portion of an outer surface of said concrete panel; said surface component extending from at least one anchor component projecting from said surface component and embedded within said concrete panel; said first flexible seal member further including an overlap component which is integral with the surface component of the first flexible seal member and which extends from said surface component beyond said first end of said concrete panel; and a second flexible seal member proximate a second, opposite end of an abutting said concrete panel; said second flexible seal member including a surface component extending over a portion of a surface of said abutting concrete panel; said surface component of said second flexible seal member extending from at least one anchor component projecting from said surface component and embedded within said abutting concrete panel; and wherein the overlap component of the first flexible seal member is structured and selected in use to overlap at least a portion of the surface component of the second flexible seal member; the overlap component providing a weld face co-extensive with and facing an upper surface of the at least a portion of the surface component of the second flexible seal member; sufficient to permit welding of at least a portion of said overlap component of said first flexible seal member to at least a portion of said surface component of said second flexible seal member so as to form a continuous welded seal between and along an overlapping length of said first flexible seal member and said second flexible seal member.

2. The seal system of claim 1, wherein the length of the first flexible seal member and the second flexible seal member is a longitudinal length.

3. The seal system of claim 1, wherein the first flexible seal member is homogeneous.

4. The seal system of claim 1, wherein the second flexible seal member is homogeneous.

5. The seal system of claim 1, wherein the at least two anchor components of the first flexible seal member and the pair of anchor components of the second flexible seal member are cast into respective first and second opposite ends of the concrete panels by immersing the at least one anchor component and the pair of anchor components into at least a surface region of the concrete panels prior to the setting of the concrete from which the panels are formed.

6. The seal system of claim 5, wherein the anchor components projecting from the surface component each includes a bulbous portion or enlarged angular portion at a free edge of the anchor component.

7. The seal system of claim 1, wherein the first and second flexible seal members form a seal system extending substantially around the entire periphery of each concrete panel.

8. The seal system of claim 1, wherein the anchor component comprises a substantially continuous extension, extending substantially, continuously, longitudinally, far the length of the flexible seal member.

9. The seal system of claim 1, wherein the anchor component comprises a substantially discontinuous, periodic extension, extending substantially, longitudinally, for the length of the flexible seal member.

10. The seal system of claim 1, wherein individual panels are one or more of square, rectangular, or cruciform.

11. The seal system of claim 10, wherein the panels are of dimension one-meter by one-meter or six-meter by six-meter or six-meter by one-meter.

12. The seal system of claim 1, wherein the panels are precast panels.

13. The seal system of claim 1, wherein the panels are cast in situ.

14. The seal system of claim 1, wherein the panels are shaped.

15. The seal system of claim 1, wherein the panels are arched.

16. The seal system of claim 1, wherein a portion of the first flexible seal member between the surface component of the first flexible seal member and the Overlap component of the first flexible seal member is sufficiently flexible such that, with the surface component of the first flexible seal member and the second flexible seal member covering respective surfaces of adjacent panels that are in the same plane, the portion of the first flexible seal member is bendable to allow the overlap component of the first flexible seal member to cover the upper surface of at least the portion of the surface component of the second flexible seal member.

* * * * *